US006385422B1

(12) United States Patent
Ishiguro et al.

(10) Patent No.: US 6,385,422 B1
(45) Date of Patent: May 7, 2002

(54) DEVELOPING UNIT EQUIPPED WITH A TONER REPLENISHING DEVICE CONFIGURED WITH A CONVEYING SHEET AND ROTATOR

(75) Inventors: Yasuyuki Ishiguro, Higashiosaka; Tsutomu Nagata, Hirakata; Masatoshi Kaneshige, Ikoma; Toshio Nishino, Yamatokoriyama; Hiroshi Tanisawa, Nara; Jun Yamaguchi, Ikoma; Yoshinori Otsuka, Tenri; Hiroshige Araki, Yamatokoriyama, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/675,212

(22) Filed: Sep. 29, 2000

(30) Foreign Application Priority Data

Oct. 1, 1999 (JP) ..... 11-281169
Nov. 17, 1999 (JP) ..... 11-326326

(51) Int. Cl.[7] ..... G03G 15/08
(52) U.S. Cl. ..... 399/258; 399/263
(58) Field of Search ..... 399/254, 255, 399/258, 262, 263

(56) References Cited

U.S. PATENT DOCUMENTS 5,202,732 A * 4/1993 Yahata ..... 399/263
5,655,195 A * 8/1997 Ichikawa et al. ..... 399/263
5,697,038 A * 12/1997 Hatta et al. ..... 399/262 X
5,734,952 A * 3/1998 Murakami et al. ..... 399/258 X
5,884,130 A * 3/1999 Tsutsumi et al. ..... 399/254
6,088,561 A * 7/2000 Kawamura et al. ..... 399/262

FOREIGN PATENT DOCUMENTS

| | | |
|---|---|---|
| JP | Sho-63213877 | 9/1988 |
| JP | Hei-6236110 | 8/1994 |
| JP | Hei-7271163 | 10/1995 |
| JP | Hei-10123815 | 5/1998 |

* cited by examiner

*Primary Examiner*—Fred L Braun

(57) ABSTRACT

A developing unit includes a developing hopper, a toner reserve container that incorporates a replenishing roller and a replenishing port forming a toner replenishing portion, arranged adjacent to the developing hopper in order to supply the toner to the developing hopper. The toner reserve container further includes an agitator rotatable about a rotary shaft and a conveying sheet attached to the agitator for conveying the toner to the replenishing roller. The conveying sheet has a bent portion where the conveying sheet is bent in the rotational direction of the agitator at a halfway point thereof with a predetermined angle α. Deformation of the conveying sheet during rotation is absorbed around the position of the bent portion, so that the conveying sheet will not be plastically deformed at the attached part of the conveying sheet joined to the attachment edge of the agitator, whereby long stable toner conveyance by the conveying sheet can be maintained.

16 Claims, 19 Drawing Sheets

Before deformation

After deformation

Before deformation

After deformation

DEVELOPING UNIT EQUIPPED WITH A TONER REPLENISHING DEVICE CONFIGURED WITH A CONVEYING SHEET AND ROTATOR

BACKGROUND OF THE INVENTION (1) Field of the Invention

The present invention relates to a developing unit for use in an image forming apparatus such as a laser printer, copier, facsimile machine etc., and in particular relates to a technology for replenishing, as required, the developing hopper as a part of a developing unit, with the toner for image development.

(2) Description of the Prior Art

An image forming apparatus such as a laser printer, copier, facsimile machine, etc., utilizing the electrophotographic technique, has an image forming portion for forming a desired image on a sheet for recording. In this image forming portion, the surface of a photosensitive member as an image bearer is uniformly electrified with charge of a particular polarity and then is illuminated with an optical image so as to form a static latent image corresponding to the image. For the purpose of visualizing this static latent image, the image forming portion includes a developing unit and other components. The developing unit is configured of a developer hopper holding a developer and having a developing roller etc., for supplying the developer to the developing position where the developing roller opposes the photosensitive member. Further, since the toner in the developing hopper is consumed, a toner replenishing device for replenishing the developing hopper with the toner as necessary is arranged adjacent to the developing hopper, thus configuring the developing unit.

In a developing unit of the above type, if the toner reserve container for replenishing the developing hopper with the developer is arranged on the top, the developing unit would be bulky as to its height so a waste space would arise inside the image forming apparatus, thus making the whole image forming apparatus bulky. For this reason, the toner reserve container is horizontally arranged adjacent to the developing hopper to reduce the height of the developing unit, thus making the developing unit into a thinned configuration and hence making it possible to configure a compact image forming apparatus as a whole by eliminating the unnecessary space which would arise inside the image forming apparatus.

An example of such a developing unit is disclosed in Japanese Patent Application Laid-Open Sho 63 No.213877. In this developing unit, the toner reserve container is arranged at the side of the developing hopper and has a conveying element that conveys and agitates the toner inside the toner reserve container so that the conveying element feeds (supplies) the toner into the toner replenishing portion from which the toner is supplied to the developing hopper.

Japanese Patent Application Laid-Open Hei 10 No.123815 has proposed a developing unit having a toner replenishing device having a simpler configuration compared to the developing unit disclosed in the aforementioned publication. This developing unit 60 comprises, as shown in FIG. 1, a developing hopper 61 which incorporates an agitating roller 62 for agitating the developer stored in developing hopper 61 and a developing roller 63 for conveying the developer to the developing area that opposes the photosensitive member. Further, a toner reserve container 64 is horizontally arranged at the side of developing hopper 61. Toner reserve container 64 stores toner 69 for replenishment and incorporates an agitator 65 that agitates and conveys the stored toner 69.

Formed between developing hopper 61 and toner reserve container 64 is a toner supply opening 66, at which a toner replenishing roller 67 made up of sponge etc., for replenishing the toner into developing hopper 61 with the toner is positioned. The agitator 65 is rotated in the direction of the arrow in the drawing during toner replenishment so as to feed the toner to replenishing roller 67 whilst agitating the toner stored in toner reserve container 64.

Agitator 65 is configured of rotational, agitating vanes (a pair of plates arranged on both sides) with a conveying sheet 68 of a flexible sheet-like element, attached at one, end of the vanes. Accordingly, as agitator 65 is turned, conveyer sheet 68 scoops up the toner 69 accumulated or stored at the bottom of toner reserve container 64 whilst agitating it and collects the toner thereover to feed it to replenishing roller 67. During this, the toner 69 over the sheet is supplied to replenishing roller 67 by making use of the force of action that causes conveying sheet 68 to restore itself due to its own flexibility.

In a developing unit of this kind, toner reserve container 64 is arranged at the side, and agitator 65 etc., are provided in the toner reserve container 64, whereby toner 69 in toner reserve container 64 can be conveyed completely to toner replenishing roller 67. Thus, the toner storage volume can be increased by enlarging the developing unit horizontally while the height of the developing unit can be suppressed.

In the developing units shown in FIG. 1, since toner reserve container 64 is horizontally arranged at the side of developing hopper 61, there is no increase in height. However, if the toner storage volume of toner reserve container 64 is further increased, the height cannot but increase.

If toner reserve container 64 is enlarged only in the horizontal direction in order to increase the toner storage volume, agitator 65 shown in FIG. 1 cannot agitate and convey the toner well enough. That is, if the distance of conveying sheet 68 from the fixed end to the distal end is set long enough to convey the toner in the vertical direction, it is difficult to secure good enough performances of agitation and conveyance of the toner in the left and right, or lateral direction. As a result, the toner inside toner reserve container 64 cannot be completely used and a certain toner will remain unused. Further, the remaining toner is not agitated and hence the toner gathers into a mass in the stationary area of the toner reserve container 64, which may then be fed into the agitable area by some reason such as vibration etc. for instance, and hence the aggregation may be fed to replenishing roller 67. When such a toner aggregation is fed to developing hopper 61, it may cause development failures, or other deficiencies.

For these reasons, in the apparatus disclosed in Japanese Patent Application Laid-Open Hei 10 No.123815, the rotary shaft 65*a* of agitator 65 is set off-centered closer to the developing hopper 61 side while conveying sheet 68 when it is positioned horizontally is formed long enough so that its front end reaches the right side wall (rear wall) of toner reserve container 64 in FIG. 1, whereby toner supply can be stabilized while securing a desired amount of toner for replenishment and eliminating toner stagnation. In FIG. 1, a reference numeral 71 designates a regulating element for limiting the developer adhering to developing roller 63 to the predetermined amount and 72 designates a concentration detector for detecting the toner concentration of the developer in developing hopper 61.

Here, in accordance with the toner replenishing device having a configuration shown in FIG. 1, toner 69 in toner reserve container 64 is adapted to be scooped up and fed to the replenishing portion from above to replenishing roller 67. In contrast to this, those disclosed in Japanese Patent Application Laid-Open Hei 6 No.236110 and Japanese Patent Application Laid-Open Hei 7 No.271163 are configured so that the toner in the toner reserve container is scooped up and fed from below (underhand configurations). In these cases where the toner is fed in such a manner, the rotary shaft of the agitator needs to be positioned above the replenishing portion so that the configuration inevitably tends to be greater in height.

Here, in the developing unit thus configured shown in FIG. 1, the toner reserve container 64 is configured so that its dimensions or its volume can be made as large as possible in order to reduce the frequency of charging the toner to toner reserve container 64. Therefore, toner reserve container 64 should become greater proportionally with the increase of the stored amount of the toner. In order to suppress the increase in height, toner reserve container 64 is enlarged in the lateral direction in the figure. Conversely, in order to suppress the increase in size of the lateral direction, the depth or the size in the vertical direction should be enlarged. Anyway, the volume of toner reserve container 64 should be enlarged.

Therefore, in the toner replenishing device configured as shown in FIG. 1, in order to agitate the whole toner 69 stored in toner reserve container 64 as uniformly as possible and feed it to developing hopper as efficiently as possible, it is necessary to convey the toner to replenishing roller 67 in a high enough amount. For this reason, conveying sheet 68 attached to agitator 65 is provided so as to be elongated as much as possible. In other words, the distance of conveying sheet 68 from its attached position with agitator 65 to its distal end is adapted to be long.

Contrary to expectation, if conveying sheet 68 is formed to be long, the agitating and conveying performances lower because of difficulties in securing the rigidity of conveying sheet 68. This conveying sheet 68 is made up of a flexible material. The conveying sheet is formed of polyethylene terephthalate (PET) film etc., for example so as to have good flexibility and have a tolerance against deformation and curving.

Particularly, as the toner is conveyed by the rotation of agitator 65, conveying sheet 68 becomes curved and deformed repeatedly, so that the sheet may become plastically deformed and bent, unable to reset its curvature and deformation and hence lose its conveying performance and its toner agitating performance. For example, conveying sheet 68 may be plastically deformed, becoming bent at the part joined to the attachment edge of agitator 65 in FIG. 1 and failing to recover its original shape.

In most cases, conveying sheet 68 becomes bent and the plastically deformed portion becomes whitened. The whitening is the phenomenon that the portion having had loads applied thereto is caused to plastically deform and the properties, performance, mechanical characteristics etc. of the part become lowered, not reaching breakdown or rupture but the damaged portion becomes wrinkled forming into a cloudy white compared to the background color of the surrounding resin. This causes lowering of conveyance and agitation due to deformation of the conveying sheet.

SUMMARY OF THE INVENTION

In view of the above problems, it is an object of the present invention to provide a developing unit equipped with a toner replenishing device wherein the toner in the toner reserve container can be sufficiently fed and brought to the toner replenishing portion with an improved conveying performance.

It is a particular object of the present invention to provide a developing unit equipped with a toner replenishing device wherein toner conveyance can be secured for a long period of time by reducing deformation of the conveying sheet and preventing its elastic breakdown etc., with a simple structure and stable toner replenishment is ensured especially when a large toner reserve container is used.

The developing unit equipped with a toner replenishing device in accordance with the first invention to achieve the above object is a developing unit equipped with a toner replenishing device which has a toner reserve container for supplying the toner to a developing hopper as required and a replenishing portion for supplying the toner stored in the toner reserve container to the developing hopper, including: a rotator incorporated in the toner reserve container so as to be rotatable for agitating the stored toner; and a conveying sheet of a flexible material attached to the rotator for scooping up the toner stored in the toner reserve container and conveying the toner into the replenishing portion and being characterized in that the conveying sheet is bent in the rotational direction of the rotator at a halfway point thereof with a predetermined angle a, forming a bent portion.

For example, as shown in FIG. 5, the conveying sheet (58) is bent at a halfway point with an angle a forming a bent portion **(58*a*). When the rotator (57) rotates and the conveying sheet becomes deformed as it comes into sliding contact with the inner wall of the toner reserve container, the deformation is relieved around the position of bent portion 58*a* so as to inhibits the conveying sheet from being greatly deformed at the attachment edge d of the rotator. As a result, no plastic deformation or the like of the conveying sheet will occur at the attachment edge d, thus making it possible to maintain the necessary stable toner conveyance for a long period. In the conventional configuration, when the rotator rotates and the conveying sheet is deformed as shown in FIG. 6**, the part of the conveying sheet joined to the attachment edge d of the rotator is deformed greatly. Repeated stress acting on this area causes the sheet to be plastically deformed, so the toner conveyance tends to lower gradually. In the present configuration, however, stresses arising in the conveying sheet can be relieved around the bent portion provided at a halfway point to thereby prevent such plastic deformation.

Next, in the apparatus having the configuration of the first invention, the same operation effect can be obtained if the bent portion is formed in a curving shape. Since the bent portion is formed of a curving structure instead of an angled configuration, a longer life can be expected.

Further, in the apparatus having the configuration of the first invention, setting the angle a at the bent portion within the range from 90° to 170° assures sufficient toner conveyance and can prevent plastic deformation as stated above, thus making it possible to maintain stable conveyance in the long term.

In the unit having the configuration of the first invention, h is set at a value within the range of $(H/4) \leqq h \leqq (2H/3)$, where H is the distance from the attached position of the conveying sheet with the rotator to the bottom of toner reserve container and h is the distance from the position of the bent portion of the conveying sheet to the attachment edge of the rotator. Therefore, the bent portion can be positioned within the appropriate range related to the dimensions of the toner reserve container. In this way, the bent portion is specified appropriately based on the capacity and size of the toner reserve container, or the stored amount of the toner, beyond mere provision of the bent portion, so that it is possible to maintain a more stabilized conveyance.

Moreover, in the apparatus having the configuration of the first invention, h is set at a value within the range of $20t \leqq h \leqq 100t$, where t is the thickness of the conveying sheet and h is the distance from the position of the bent portion of the conveying sheet to the attachment edge of the rotator. Therefore, it is possible to specify the size of the bent portion appropriately relative to the thickness of the conveying sheet. In particular, since the bent portion is set closer to the attached portion of the conveying sheet with the rotator when the conveying sheet is thin whereas the bent portion is set distant from the attached portion of the conveying sheet with the rotator when the conveying sheet is thick, it is possible to effectively prevent plastic deformation of the conveying sheet and hence maintain its stable conveying function.

The apparatus of the second invention to achieve the above object is a developing unit equipped with a toner replenishing device which has a toner reserve container for supplying the toner to a developing hopper as required and a replenishing portion for supplying the toner stored in the toner reserve container to the developing hopper, including: a rotator incorporated in the toner reserve container so as to be rotatable for agitating the stored toner; and a conveying sheet of a flexible material attached to the rotator for scooping up the toner stored in the toner reserve container and conveying the toner into the replenishing portion and being characterized in that the conveying sheet is composed of a fixed portion for attachment to the rotator and a conveying portion for scooping up and conveying the toner on the free end side, having a thickness smaller than that of the fixed portion.

In other words, the fixed portion for fixing the conveying sheet to the rotator is made thicker while the conveying portion connected thereto and in charge of toner conveyance is made thinner. Therefore, even if the conveying sheet deforms greatly when scooping and conveying the toner, the thinner part, i.e., the conveying portion only deforms greatly. Thus, similar to the above first invention, the deformation can be absorbed by the conveying portion, so that plastic deformation of the fixed portion at the attachment edge of rotator can be effectively prevented. Moreover, since the fixed portion of the conveying sheet is formed to be thick, it is possible to effectively perform toner agitation and conveyance while providing sufficient rigidity of the conveying sheet.

In the apparatus having the configuration of the second invention, the fixed portion and conveying portion having different thicknesses and constituting the conveying sheet can be formed by integral molding or by lamination. Particularly, use of the injection molding process facilitates fabrication of an integrated conveying sheet having a stepped configuration. Alternatively, lamination of multiple sheets facilitates fabrication of a conveying sheet having a stepped configuration. For example, the conveying sheet may be formed in a simple manner by laminating and joining one or two sheets of film having a necessary thickness to one or both sides of a sheet of film having the same thickness. Thereby, it is possible to prevent plastic deformation of the fixed portion being attached to the rotator, and hence maintain stable toner conveyance for a long time.

In the apparatus having the configuration of the second invention, h is set at a value within the range of $(H/4) \leqq h \leqq (2H/3)$, where his the distance from the position at which the thickness of the conveying sheet changes between the fixed portion and the conveying portion to the attachment edge of the rotator and H is the distance from the attached position of the fixed portion with the rotator to the bottom of toner reserve container. This setting enables the conveying sheet to be configured in accordance with the toner storage capacity of the toner reserve container and to provide stable toner conveyance for a long period, thus making it possible to enhance the effect of preventing plastic deformation.

The apparatus of the third invention to achieve the above object is a developing unit equipped with a toner replenishing device which has a toner reserve container for supplying the toner to a developing hopper as required and a replenishing portion for supplying the toner stored in the toner reserve container to the developing hopper, including: a rotator incorporated in the toner reserve container so as to be rotatable for agitating the stored toner; a conveying sheet of a flexible material attached to the rotator for scooping up the toner stored in the toner reserve container and conveying the toner into the replenishing portion; and a reinforcing element arranged protectively in the rotational direction of the rotator and attached to the rotator and being characterized in that the conveying sheet is attached to the rotator via the reinforcing element.

In accordance with this invention, the conveying sheet, especially its rigidity, is reinforced by the reinforcing element. Therefore, a high enough toner conveyance can maintained. Further, since the conveying sheet is inhibited by the reinforcing element from being bent greatly, so that no reduction in toner conveyance occurs due to plastic deformation and hence it is possible to keep stable toner conveyance for a long period. Therefore, it is possible to use the conveying sheet in the long term.

In the apparatus having the configuration of the third invention, the conveying sheet is bonded to the reinforcing element at an area corresponding to the area where the reinforcing is attached to the rotator and the other part of the conveying sheet is unbonded with respect to the reinforcing element. Accordingly, the deformation of the conveying sheet is constrained greatly by the reinforcing element so that the conveying sheet is deformed greatly but plastic deformation at that portion can be inhibited. With the deformation of the conveying sheet constrained by a reinforcing element, the conveying sheet will be deformed at the area where no reinforce element is present by the loads from the inner face of the toner reserve container and from the toner and the deformation cannot be absorbed so that the stresses may concentrate on that portion, possibly causing plastic deformation. However, the conveying sheet is not bonded in whole area of the reinforcing element, so that the deformation due to the loads is dispersed and hence there is no fear of plastic deformation occurring.

Next, in the apparatus having the configuration of the third invention, when the reinforcing element is formed of a material thicker than the conveying sheet, this configuration naturally, reinforces the conveying sheet and hence gives high enough rigidity to the conveying sheet, to thereby enhance the toner conveyance.

In the apparatus having the configuration of the third invention, when the reinforcing element has a bent or curved portion at the distal end thereof, it is possible to enhance the reinforcing effect of the reinforcing element and hence improve the toner conveyance. When the conveying sheet is deformed by the loads from the inner surface of the toner reserve container and the toner, the conveying sheet being deformed is supported by the distal part of the reinforcing element, which causes concentrated deformation on the distal part. Therefore, the reinforcing element would give way losing its rigidity. However, because the reinforcing element of this configuration has a bent or curved portion at the distal part, this reinforcing element is able to secure its rigidity and functions to provide rigidity to the conveying sheet and hence provides high enough toner conveyance function.

In the apparatus having the configuration of the third invention, when the reinforcing element is greater in thickness or longer in projected amount in the areas corresponding to both extremes of the conveying sheet than in the area corresponding to the central area of the conveying sheet, it is possible to maintain the toner conveyance at the both extremes of the conveying sheet so that the distribution of the amount of toner conveyance can be made approximately uniform with respect to the longitudinal direction of the conveying sheet. Particularly, when the conveying sheet deforms, it tends to deform to a higher degree in both extremes than in the central part. Therefore, the reinforcing element is longer in projected amount or greater in or thickness in the both extremes than in the central part, to enhance the reinforcement on the conveying sheet at both extremes. Thereby, it is possible to make the conveying performance approximately uniform across the full range.

In the apparatus having the configuration of the third invention, when the width (W) of the bent or curved portion at the distal end of the reinforcing element is made greater in the areas corresponding to both extremes of the conveying sheet than in the area corresponding to the central area of the conveying sheet, it is possible to make the toner conveying performance approximately uniform across the length of the conveying sheet.

In the apparatus having the configuration of the third invention, when the reinforcing element is formed with a corrugated structure having a section of a continuous semicircular, trapezoidal, sinusoidal or other concavo-convex series, it is possible to further enhance the reinforcing effect. In this case, if the reinforcing element is equal in thickness to, or thinner than, the conveying sheet, it is possible to provide high enough reinforcing effect and hence secure high enough toner conveyance.

In the apparatus having the configuration of the third invention, similarly to the above first and second inventions, as to the projected amount of the reinforcing element, h is set at a value within the range of $(H/4) \leqq h \leqq (2H/3)$, where h is the projected amount of the reinforcing element and H is the distance from the attached position of the fixed portion with the rotator to the bottom of toner reserve container. This setting assures the toner conveyance and enables stable toner conveyance even if the conveying sheet is used in the long term.

Next, the apparatus of the fourth invention to achieve the above object is a developing unit equipped with a toner replenishing device which has a toner reserve container for supplying the toner to a developing hopper as required and a replenishing portion for supplying the toner stored in the toner reserve container to the developing hopper, including: a rotator incorporated in the toner reserve container so as to be rotatable for agitating the stored toner; and a conveying sheet of a flexible material attached to the rotator for scooping up the toner stored in the toner reserve container and conveying the toner into the replenishing portion and being characterized in that the conveying sheet has a tapered configuration such that the thickness becomes gradually thinner from the position attached to the rotator toward the free end side which performs toner conveyance.

Illustratively, the conveying sheet is thick at the portion to be attached to the rotator and gradually becomes thinner or tapered as it approach to the distal end for conveying the toner. Therefore, it is possible to inhibit plastic deformation of the fixed part of the conveyance sheet joined to the rotator, whereby toner conveyance can be continuously kept for a long time. Similarly to the second invention, though the conveying sheet deforms at its distal part that scoops and conveys the toner, plastic deformation at the attached end portion with the rotator can be inhibited.

In the apparatus according to the first through fourth inventions, when the conveying sheet to be attached to the rotator is integrally molded, there is no risk of the sheet being peeled off, so that it is possible to keep more stabilized conveyance compared the case where the conveying sheet is bonded and fixed to the rotated. Further, the positioning of the conveying sheet to the rotator can be improved in accuracy, which makes it possible to provide more stabilized toner conveyance. In this case, owing to recent advances in the field of injection molding, use of an injection molding technique makes it possible to perform integral molding of the rotator and conveying sheet using two different materials. Therefore, when the integral molding is produced by selecting the most suitable materials for the rotator and conveying sheet, respectively, it is possible to provide a configuration which has the advantages described heretofore and presents full functions and realize improved toner agitation and conveyance. In particular, the distal end part of the conveying sheet or the part which comes in sliding contact with the inner wall surface of the toner reserve container, can be formed with a material excellent in slidability, where by a further beneficial effect can be expected.

DESCRIPTION OF THE PREFERRED EMBODIMENTS

Figure 2:
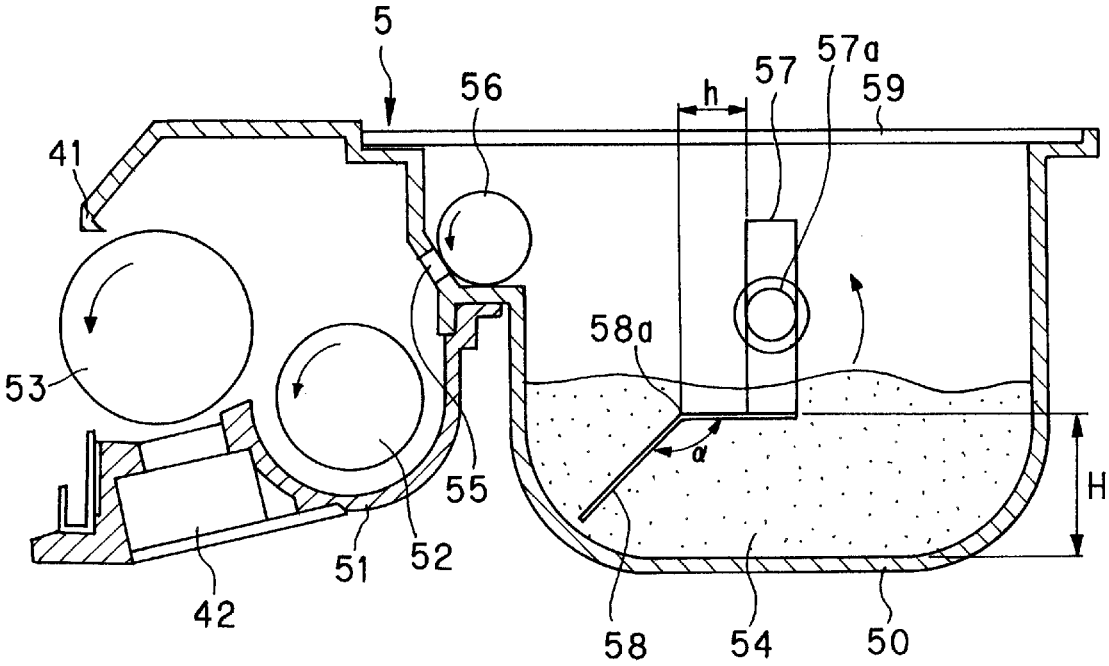
FIG. 2 is a sectional view showing a structure of a developing unit equipped with a toner replenishing device in accordance with the first embodiment of the invention.
Figure 3:
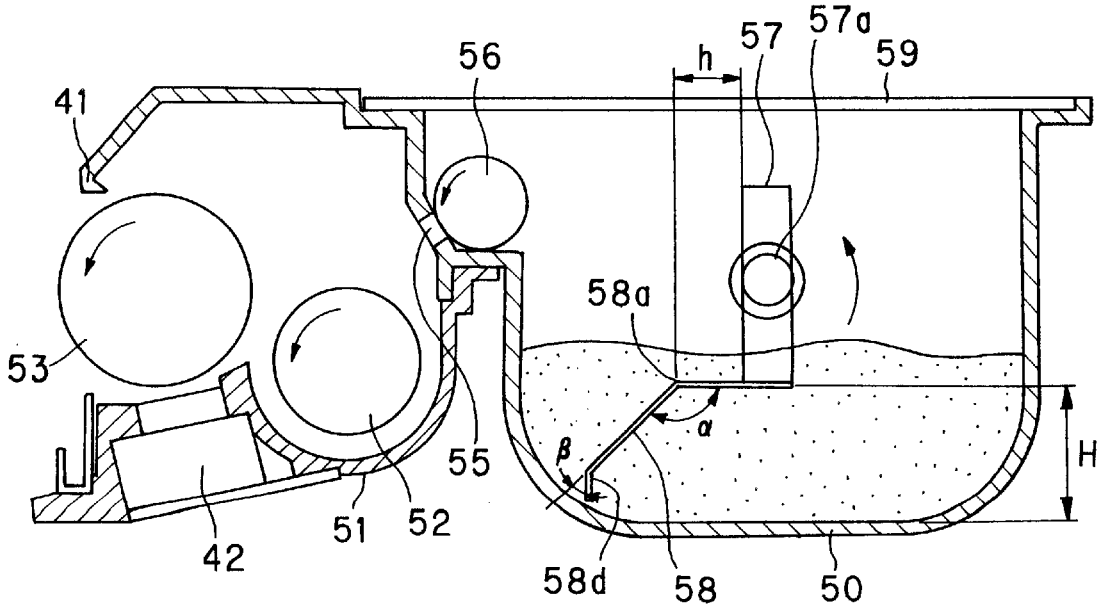
FIG. 3 is a sectional view showing a variation of a developing unit the first embodiment shown in FIG. 2 of the invention.
Figure 4:
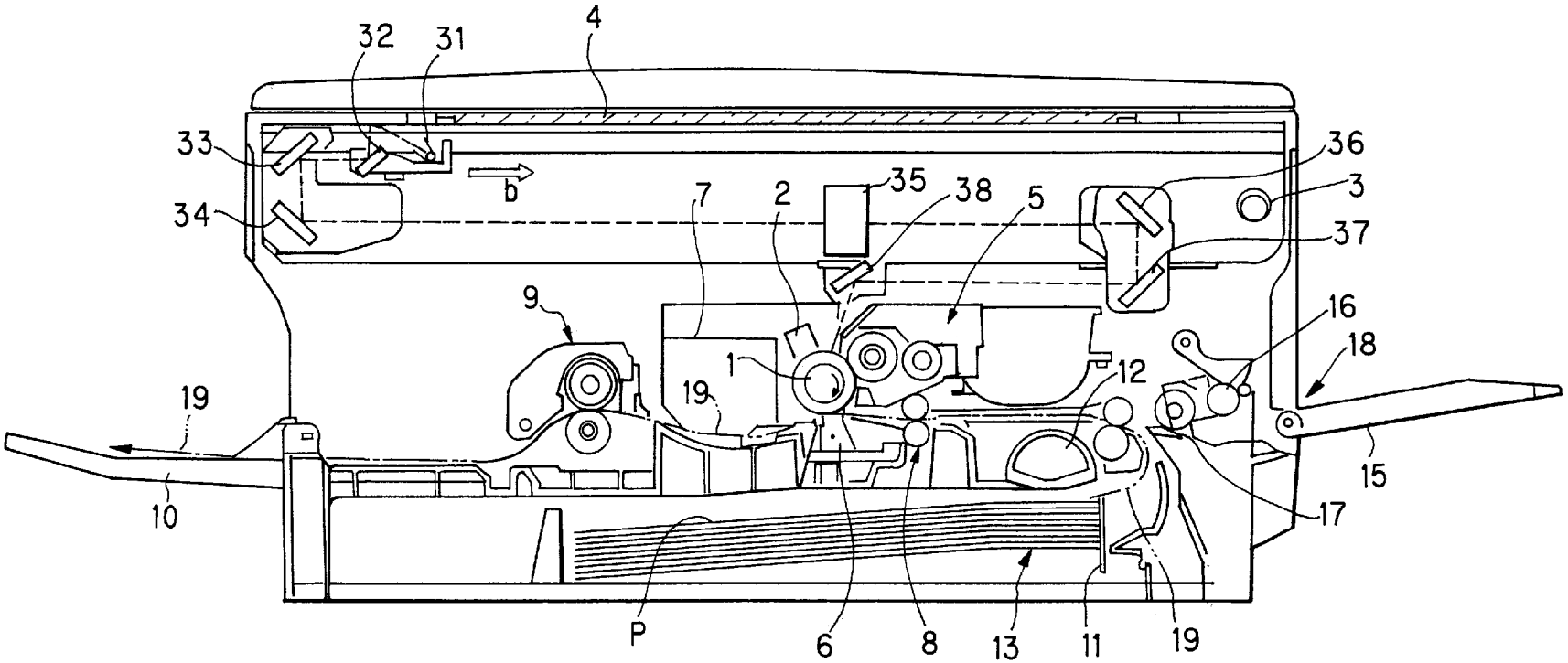
FIG. 4 is a sectional view showing an example of the overall configuration of an image forming apparatus having a developing unit equipped with a toner replenishing device shown in FIG. 2 or FIG. 3.

The embodiments of the present invention will hereinafter be described in detail with reference to the accompanying drawings. FIG. 2 is a sectional view showing a developing unit equipped with a toner replenishing device in accordance with the first embodiment of the invention. FIG. 3 is a sectional view showing a variation of that shown in FIG. 2, where a modified toner conveying sheet as a part of the toner replenishing device is provided. FIG. 4 is a sectional view showing the internal configuration of a copier as an example of an image forming apparatus having a developing unit equipped with a toner replenishing device of the present invention.

To begin with, before description of the embodiment of a developing unit of the present invention, the image forming apparatus shown in FIG. 4 will be described. The developing unit equipped with a toner replenishing device of the present invention can not only be applied to copiers but of course applied as is to the developing units of printers, facsimile machines, etc., which use electrophotography.

As shown in FIG. 4, the copier has an image forming portion composed of, in its center, a photosensitive member 1 which rotates in a direction indicated by the arrow, a charger 2 uniformly charging the photosensitive member surface; a developing unit 5 for developing the electrostatic latent image which has been formed on the photosensitive member by illuminating the image of an original placed on an original table 4 through an optical system 3; a transfer device 6 for transferring the toner image formed on the photosensitive member surface to a sheet which has been fed by a sheet feed device described below; a cleaning unit 7 for removing the leftover toner remaining after transfer; and the like.

Optical system 3 for illuminating photosensitive member 1 with the image of the original includes: a scanner composed of an exposure lamp 31 disposed below original table 4 for illuminating the original and mirrors 32, 33 and 34 which properly reflect the reflected light from the original; a lens 35 focusing the reflected light from the original onto the surface of photosensitive member 1; and fixed reflection mirrors 36, 37 and 38 which finally lead the reflected light from the original through lens 35 onto photosensitive member 1. Accordingly, the first scanner portion composed of mirror 32 and exposure lamp 31 as part of the scanner is made to travel at a uniform speed along original table 4, while the second scanner portion composed of mirrors 33 and 34 is made to travel in the same direction as the first scanner portion but at half the speed of that of the first scanner portion. By this operation, the image of the original can be sequentially exposed slit-wise to light as photosensitive member 1 rotates, making it possible to create an focused image of the original image on the surface of photosensitive member 1.

There is also a configuration in which, instead of optical system 3 of the above configuration, the image of an original is digitally captured by focusing the image via a focusing lens 35 on an image reading device of photoelectric transducer, for example, a CCD or the like so that the surface of photosensitive member 1 is illuminated with a laser beam from a semiconductor laser which is selectively controlled based on the captured image data. This configuration is known as a digital copier. The configuration shown in FIG. 4 is of an analog copier and distinguished from the digital copier. The present invention can be applied as is to either of these.

When optical system 3 exposes the photosensitive member to the original image (optical image), a static latent image in accordance with the original image is formed on the surface of photosensitive member 1 which has been uniformly charged by charger 2. This static latent image is developed in the next step, i.e., developing unit 5, where toner as a coloring agent is made to adhere so as to create a visual image.

The toner image created on the surface of photosensitive member 1 is transferred by the action of transfer device 6 to a sheet which is being conveyed as appropriate from the sheet feed device. The sheet has been previously conveyed up to the position of a registration roller 8, and is delivered out by registration roller 8 to the transfer station (image forming station) facing transfer device 6, at the timing in synchronization with the rotary movement of photosensitive member 1.

The sheet after transfer is separated from the surface of photosensitive member 1 and then is conveyed along the guide surface to heat fixing roller 9. As it passes through heat fixing roller 9, the toner image formed on the sheet is fixed as a permanent image. Thereafter the sheet is discharged onto a sheet output tray 10 which is projected out from the copier body.

Next, the sheet feed device for feeding sheets to registration roller 8 will be described. The sheet feed device includes: a cassette feeder portion 13 which is disposed in the lower part of the copier body and includes: a sheet feed roller 12 for delivering sheets P accommodated in a sheet cassette 11 which can be detachably fitted to the machine body (can be withdrawn to the front side in the drawing); and a manual paper feeder 18 having a sheet tray 15 on which a multiple number of sheets β can be placed and being composed of a pickup roller 16 over and opposing the tray, a sheet feed roller 17 for separating and feeding the sheet P delivered by pickup roller 16.

In the figure, a reference numeral 19 shows the conveyance path of sheet P fed from the sheet feed device, in particular, from cassette feeder portion 13.

Next, description will be made of one embodiment of developing unit 5 in accordance with the present invention in which the performance of the toner replenishing device to convey the toner to the toner replenishing portion is improved.

The First Embodiment of the Invention

FIG. 2 shows the configuration of developing unit 5 in accordance with the first embodiment of the invention as stated heretofore. In FIG. 2, developing unit 5 has a toner replenishing device having a toner reserve container 50 storing the toner. This toner reserve container 50 is horizontally arranged at the side of a developing hopper 51 as a part of developing unit 5.

As conventionally known, developing hopper 51 storing the developer in developing unit 5 is provided with a rotatable, agitating roller 52 for agitating and conveying the developer stored therein and a rotatable, developing roller 53 for conveying the developer to the developing area facing the image forming portion shown in FIG. 4, in particular, photosensitive member 1, so as to perform development. The aforementioned toner reserve container 50 is arranged adjacent to developing hopper 51.

Though not illustrated, when the developer is comprised of a toner and a carrier, the developing roller 53 is configured of a nonmagnetic, cylindrical sleeve and a magnet assembly having multiple magnetic poles accommodated therein. As the sleeve is rotated counterclockwise as shown in FIG. 2 the developer attracted by the magnetic force of the magnet assembly is conveyed in the counterclockwise direction into the developing area facing photosensitive member 1. A regulating blade 41 is provided at a position midway through conveyance and is kept from the sleeve surface in a certain relation with the sleeve in order to limit the amount of the developer adhering to developing roller 53.

Toner reserve container 50 constituting developing unit 5 of the present invention is a container for storing a toner 54 to be supplied to developing hopper 51 as required. A supplying port 55 through which toner 54 is supplied is formed between toner reserve container 50 and adjacent developing hopper 51. A toner replenishing roller 56 is rotatably arranged in such a manner that part of the peripheral surface thereof is pressed against the rim of the opening of supplying port 55. These two, supplying port 55 and replenishing roller 56 constitute the replenishing portion.

Toner replenishing roller 56 is formed of a porous material such as sponge etc. so that a large number of pores can be formed on its peripheral surface to retain toner 54 to be supplied to developing hopper 51. Therefore, as toner replenishing roller 56 rotates, the roller surface is scraped by the opening rim of supplying port 55 so that toner 54 retained by toner replenishing roller 56 is scraped off and supplied to developing hopper 51.

In order to supply toner 54 to toner replenishing roller 56, a rotatable agitator (rotator) 57 is arranged inside toner reserve container 50. This agitator 57 is rotationally driven on rotary shaft 57*a* so as to agitate toner 54 stored in toner reserve container 50. This agitator 57 is a type which is conventionally known and has no special configuration.

Figures 14A, 14B:
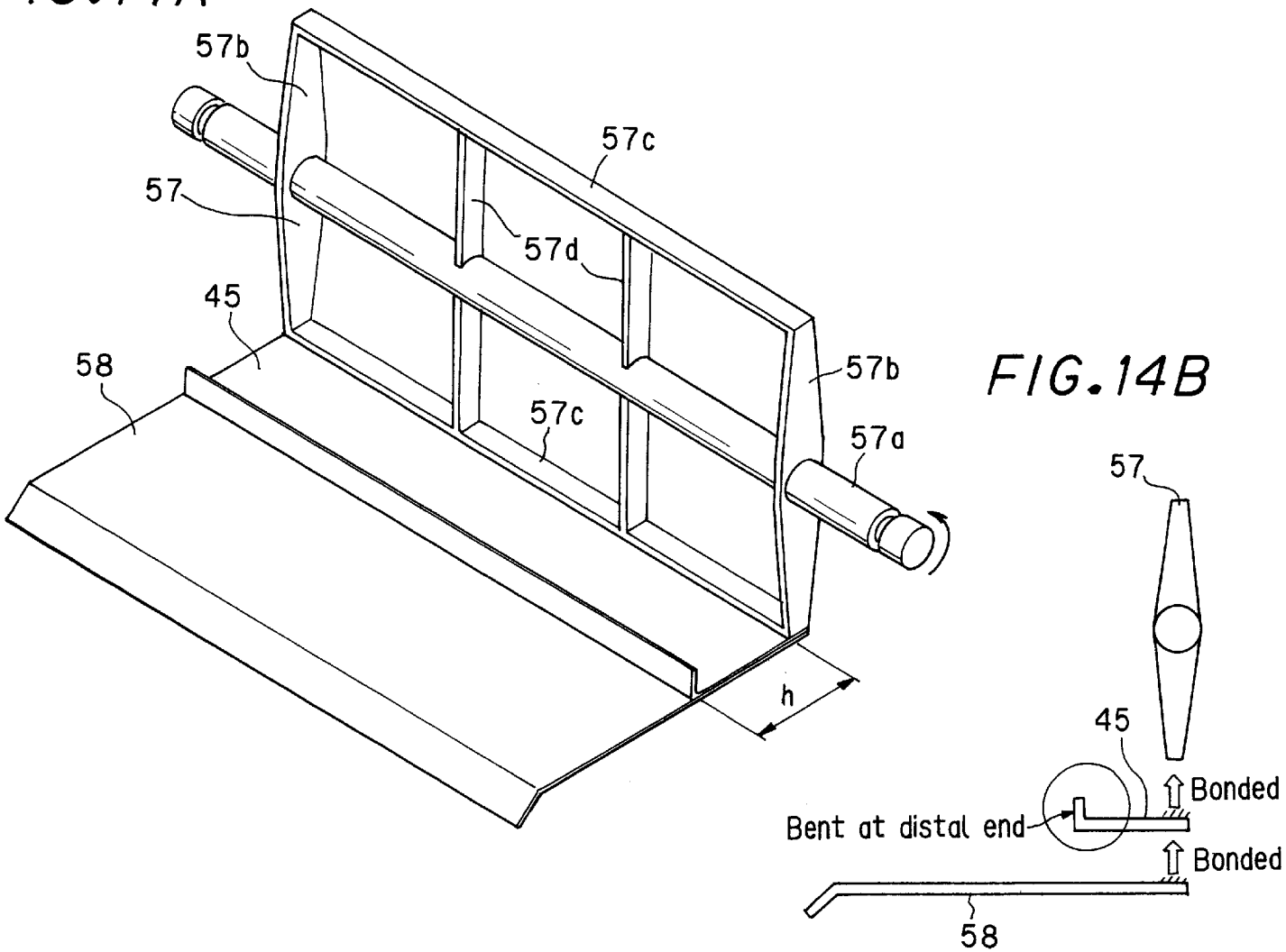
FIGS. 14A and 14B are views for illustrating the example of attachment of a reinforcing element and a conveying sheet in the third embodiment of the present invention, FIG. 14A being a perspective view showing an example of an agitator to which the element and sheet is attached and FIG. 14B being a plan view for illustrating the attachment.

Briefly referring to structure of this agitator 57, a pair of plates are arranged on both ends (on the front and rear sides in FIG. 2) of rotary shaft 57*a* with bar elements disposed in parallel with rotary shaft 57*a* or with coil springs or the like tensioned therebetween in parallel with it. The coil springs are attached to the ends of the individual plates. As shown in FIG. 14, a specific example of this agitator 57 includes: a pair of supporting plates 57*b* arranged at both ends of rotary shaft 57*a*; and a pair of agitating bars 57*c* attached to both ends of supporting plates 57*b*. In FIG. 14, a plurality of ribs (57*d*) for reinforcement are disposed between rotary shaft 57*a* and agitating bars 57*c*.

As illustrated, rotary shaft 57*a* of agitator 57 is positioned at the approximate center of toner reserve container 50, with respect to the height (the vertical direction). Agitator 57 is fixed to this rotary shaft 57*a*, which is rotationally driven, whereby agitator 57 is rotated. Fixed to at least one side of agitator 57 is one end of a conveying sheet 58, which is made up of a flexible sheet and agitates toner 54 in toner reserve container 50 and brings toner 54 into replenishing roller 56. It is of course possible to attach a pair of conveying sheets 58 to both of the aforementioned bar elements of agitator 57.

Now, the featured configuration of the conveying sheet of the present invention will be described in detail. This conveying sheet 58 is bent beforehand in the rotational direction of agitator 57 with a predetermined angle. The partway bent portion, designated at 58*a* (FIG. 2), of conveying sheet 58 is located at the approximate center with respect to the length of the conveying sheet, or with respect to the radial direction of rotation, with its bending angle α.

Provision of bent portion 58*a* as above enhances the rigidity of the sheet, whereby the toner agitating and conveying performances can be improved. Particularly, when conveying sheet 58 rotates about shaft 57*a* as agitator 57 rotates, deformation (deformation in the direction opposite the rotational direction) due to resistance acting on the sheet when the sheet scoops up toner 54, i.e., deformation due to resistance of the weight and viscosity of toner 54, is reduced by the presence of bent portion 58*a*. Thus, the rigidity of conveying sheet 58 is kept and efficient toner agitation and conveyance can be secured.

Further, since conveying sheet 58 is bent in the rotational direction at a halfway point, this shape contributes to increasing the scooped amount of the toner and hence further enhances the conveying performance. If a large amount of toner 54 is scooped up by conveying sheet 58, conveying sheet 58 will be prevented from being deformed too much at its attached part with agitator 57 because of the provision of bent portion 58*a*, as described above. Therefore, even after repeated rotations for a long period of time, conveying sheet 58 can recover its original shape without being plastically deformed, so as to maintain the same toner conveying performance as in the initial state. In one word, it is possible to effectively prevent the part of conveying sheet 58 joined to the attachment edge of agitator 57 from being plastically deformed and hence undergoing the whitening phenomenon of causing the sheet to bend irreversibly.

Figure 1:
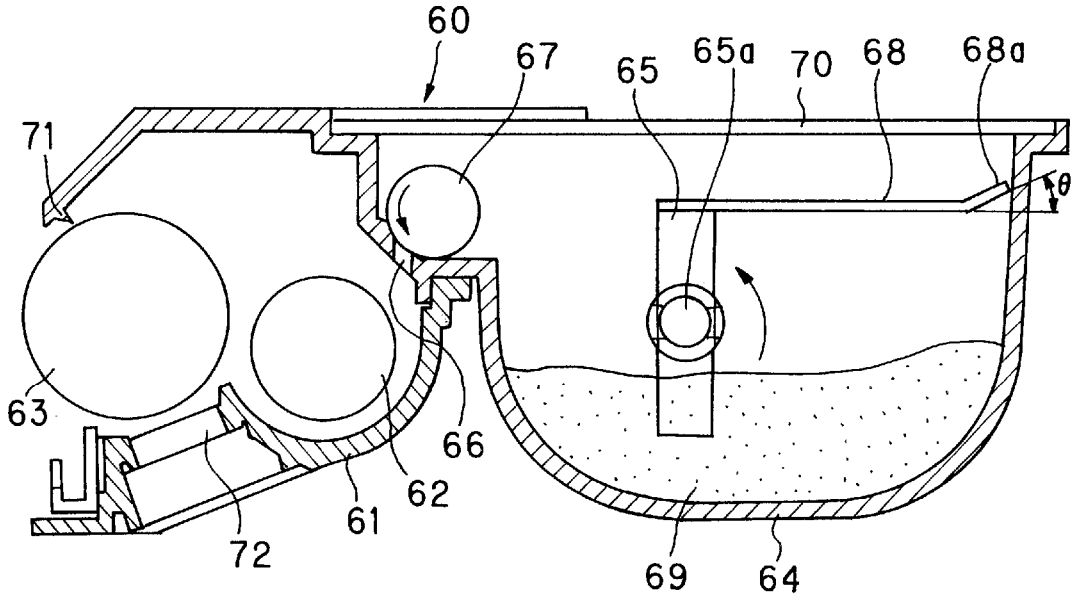
FIG. 1 PRIOR ART
FIG. 1 is a sectional view showing a specific example of a conventional developing unit equipped with a toner replenishing device.

This will be described with reference to FIG. 5 and 6. FIG. 6 shows a conventional conveying sheet 68 in FIG. 1, showing a state before deformation (FIG. 6A) and another state after deformation (FIG. 6B), where the conveying sheet is deformed by its abutment on the inner wall surface of toner reserve container 64 and resistance (load) of the toner. Conveying sheet 68, as it is rotated, is greatly bent at the attachment edge 'd' of the agitator, designated at 65 (FIG. 6B). As this has been repeated continuously, the sheet becomes plastically deformed bending at the portion 'd' instead of recovering its original shape before deformation, which leads to sharp degradation of the conveying and agitating performances.

Figure 5A:
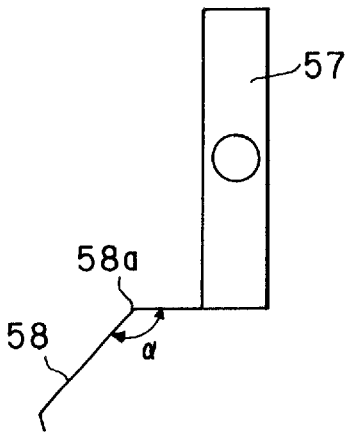
FIGS. 5A and 5B are schematic diagrams for illustrating deformation of a conveying sheet in a developing unit of the present invention, by comparatively showing the state where the agitator and conveying sheet are stationary and that where they are rotating.
Figure 5B:
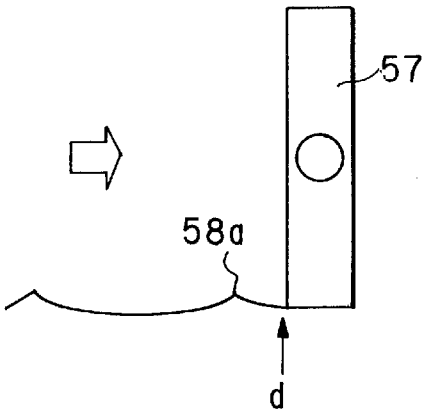
Figure 6A:
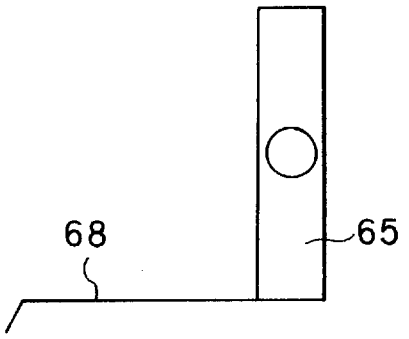
FIG.6A PRIOR ART
FIGS. 6A an 6B are schematic diagrams for illustrating deformation of a conveying sheet in a conventional developing unit, by comparatively showing the state where the agitator and conveying sheet are stationary and that where they are rotating.
Figure 6B:
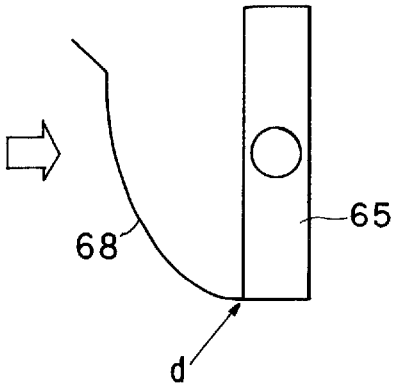
FIG.6B PRIOR ART

In contrast, in accordance with conveying sheet 58 of the present invention, bent portion 58*a* is formed as shown in FIG. 5A and 5B. Therefore, if the sheet is deformed by its abutment on the inner wall surface of toner reserve container 50 and resistance of the toner, the bent portion 58*a* is opened so that both the flaps of the sheet will be deformed greatly about bent portion 58*a*. Therefore, the part of conveying sheet 58 joined to the attachment edge (fixed portion) 'd' of agitator 57 will not deform largely, so that the folding at that portion can be avoided. Resultantly, the plastic deformation at that portion will not occur so that the sheet is free from whitening caused by repeated bending thereof after a long term use and hence can revert itself back to its original state before deformation, thus continuously maintaining stable toner conveyance and agitation.

In order to improve the efficiency of scooping up toner 54, the distal part of conveying sheet 58 may be flexed by an angle $\beta$ in the rotational direction of agitator 57, forming a toner retainer 58*d*, as shown in FIG. 3.

Here, a reference numeral 59 in FIG. 2 and 3 designates an openable/closable lid constituting the top plate of toner reserve container 50, which is opened when toner 54 is loaded into toner reserve container 50.

A reference numeral 42 designates a sensor for detecting the condition of the toner in the developer stored in developing hopper 51. This detecting sensor 42 is to detect, for example, the toner concentration in the developer, and outputs a signal indicating resupply of toner 54 if the toner concentration is equal or below a predetermined level. With this arrangement, the toner is supplied from toner reserve container 50 constituting the above toner replenishing device so that the toner concentration in developing hopper 51 can be continuously kept at a constant.

Here, the developer may be of a dual component or mono component type. A dual component developer is composed of a carrier and a toner and only the toner is consumed. Therefore, the ratio of the toner to the carrier decreases as development is carried out so that the toner concentration lowers. If a mono component developer is used, the amount of the toner in developing hopper 51 decreases as the toner is consumed. The aforementioned sensor 42 detects this fact, whereby the amount of the prescribed toner in developing hopper 51 is controlled so as to be continuously constant.

According to the thus illustrated developing unit 5 equipped with a toner replenishing device of the present invention, conveying sheet 58 has been bent beforehand at a halfway point thereof with a bending angle $\alpha$ in the rotational direction, forming a bent portion 58*a*, as shown in FIG. 2 and FIG. 3.

Therefore, as shown in FIG. 1, the structure of conveying sheet 58 of the present invention is able to maintain its rigidity by itself as stated above and provide high enough agitation and conveyance of toner 54, compared to the configuration where flat conveying sheet 68 is attached to agitator 65 as shown in FIG. 1. This means that the life of conveying sheet 58 can be made longer and sufficient, stable toner replenishment can be maintained over a prolonged period of time.

Particularly, if the dimensions in the lateral direction, for example, are enlarged in order to increase the toner storage amount of toner reserve container 50, the above configuration, even using a flexible sheet made up of PET or the like for conveying sheet 58, can maintain sufficient rigidity for a long time and hence secure necessary conveyance and agitation to provide stable toner replenishment.

Next, the operation of the above configuration will be described. Developing unit 5 is operated during image forming as illustrated above with reference to FIG. 4. That is, as developing roller 53 and agitating roller 52 are rotated, the static latent image formed on photosensitive member 1 is developed. When the toner in developing hopper 51 is consumed by the development, the decrease is detected by detecting sensor 42. In response to this detection, the toner replenishing device supplies the toner to the developing hopper 51 side.

For the toner supply, replenishing roller 56 and agitator 57 are rotated at the same time. As the agitator is driven, conveying sheet 58 abuts against the inner peripheral surface of toner reserve container 50, curving and deforming by the resistance of the toner, and agitates toner 54 accumulated at the bottom of toner reserve container 50 and scoops up the toner by conveying sheet 58 and feeds it to toner replenishing roller 56. In harmony with this movement, the toner retained on toner replenishing roller 56 is supplied thereby to developing hopper 51.

In this case, when conveying sheet 58, whilst holding the toner on its distal area, is rotated from the horizontal position shown in FIG. 2, the distal end frictionally abuts on the top plate or openable/closable lid 59 and gradually becomes deformed. The distal end of conveying sheet 58, as it is deformed by frictionally abutting openable/closable lid 59, becomes curved so that the toner scooped up thereby can be efficiently fed to replenishing roller 56. In particular, provision of toner retainer 58*d*, the portion flexed by an angle of β at the distal end of conveying sheet 58 enhances the toner holding function and enables efficient conveyance of the toner to replenishing roller 56 by eliminating toner spill more than is necessary.

During this operation, since conveying sheet 58 attached to one side of agitator 57 of the present invention is bent in the rotational direction at a halfway point, or bent portion 58*a*, it is possible to provide sufficient rigidity, and realize sufficient toner agitation and conveyance of an ample amount of the agitated toner to replenishing roller 56 in an efficient way.

FIG. 7 shows the compared result as to toner conveyance between the above configuration of the present invention and the conventional configuration. In FIG. 7, with a determined amount of toner 54 charged in reserve container 50, a conveying sheet with which agitator 57 has been continuously rotated for 90 hours and a fresh conveying sheet were evaluated, by plotting the supplied amount of toner to developing hopper 51 along the vertical axis and the time of rotation of the conveying sheet after idling and the fresh sheet along the horizontal axis. To sum up, the difference in supplied amount between the two conveying sheets is shown along the vertical axis, hence small differences over time suggest maintenance of the conveyance for a long time. The amount of dropping of toner in the charts indicates the supplied amount of toner to developing hopper 51 and is related to the amount of conveyance of the toner by the conveying sheet to replenishing roller 56 at the replenishing portion. Therefore, a greater value of this amount indicates a higher performance of conveyance.

Figure 7A:
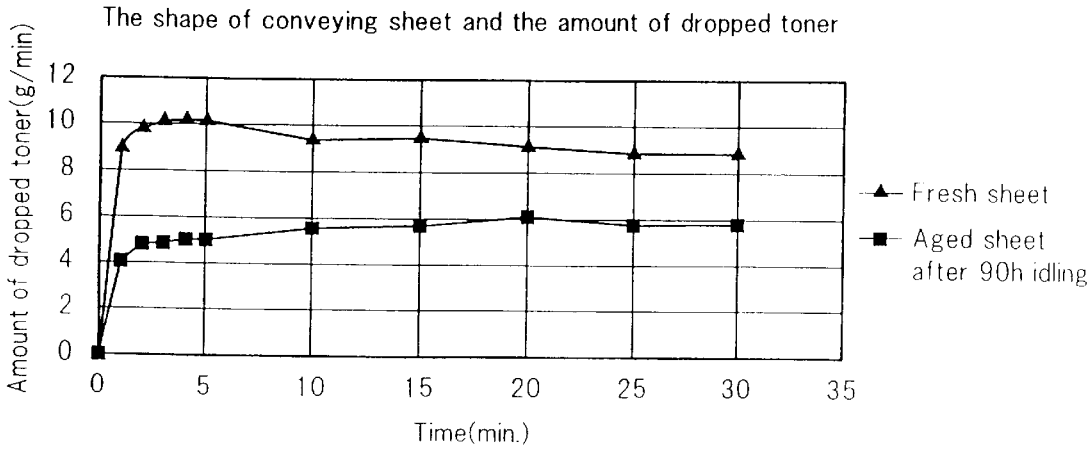
FIG. 7A PRIOR ART
FIGS. 7A to 7C show the characteristic charts of toner replenished states of the first embodiment of the present invention, FIG. 7A showing the result of the toner conveyance of a conventional conveying sheet, FIG. 7B showing the result of the toner conveyance of a conveying sheet having the structure of the first embodiment of the present invention and FIG. 7C showing the result of the toner conveyance of a conveying sheet having the structure of the third embodiment of the present invention and that of the fourth embodiment.

FIG. 7A shows the result when conventional conveying sheet 68 as shown in FIG. 1 was used. The conveying sheet after 90 hours of continues idling and aging (represented with ■ in the chart) largely differs in supplied amount from the fresh conveying sheet (represented with ▲ in the chart). Thus, the conventional conveying sheet 68 presents a long term use problem when a large amount of toner is loaded in the toner reserve container, needing frequent replacement of conveying sheet 68.

Figure 7B:
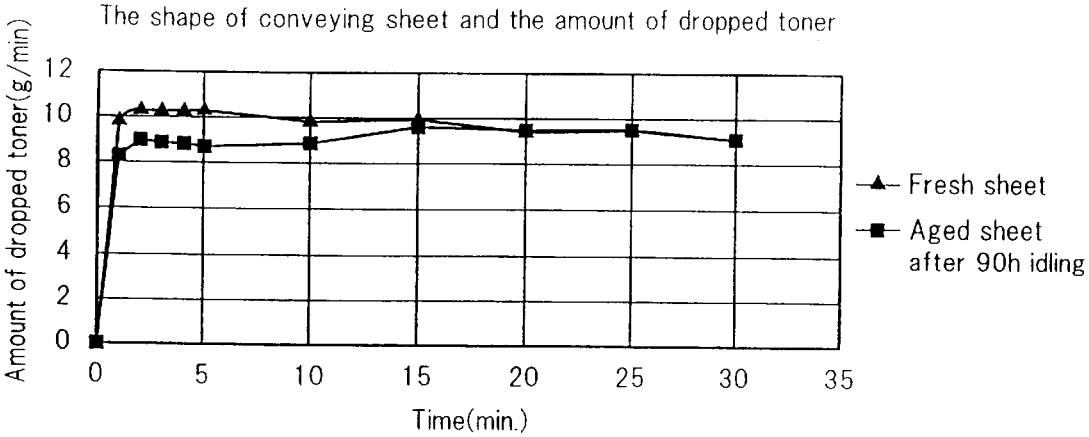

In contrast, according to the configuration of conveying sheet 58 of the present invention, i.e., that having a bent portion 58*a* at a halfway point, as shown in FIG. 7B, there is little difference in toner supplied amount (the supplied amount into developing hopper 51) between the conveying sheet 58 after 90 hours of continuous idling and aging (represented with ■ in the chart) and the fresh conveying sheet 58 (represented with ■ in the chart). Particularly, the fresh conveying sheet 58, after it was rotated about 15 minutes, presented stable toner supply with approximately uniform level of the toner supplied amount over a long period. This indicates that stable conveyance of the toner can be maintained in the long term, naturally bringing about stable toner agitation.

Here, the requirements on conveying sheet 58 of the invention, i.e. , the position of bent portion 58*a*, the bending angle α and the like to attain the aforementioned objects of the present invention and extract the maximum efficiency as well as the operation and effect of the specified requirements will be described with reference to examples.

(Concerning the Bending Angle a of Bent Portion 58*a* of Conveying Sheet 58)

In the present invention, conveying sheet 58 attached to agitator 57 has been bent beforehand at a halfway point, forming bent portion 58*a*. By setting the bending angle α of bent 58*a* of conveying sheet 58 appropriately, the result as follows could be obtained. It was found that a markedly efficient performance is obtained when the bending angle α is set so that $90° \leqq \alpha \leqq 170°$.

In the conveying sheet 58 having the structure shown in FIG. 2, the bending angle a was set at 90°, 135° and 170° while the thickness t of conveying sheet 58 was set at t=0.188 mm.

With the conveying sheets 58 as stated above, the amount of dropped toner or the amount of toner supplied to developing hopper 51 by the conveying sheet aged after 90 hours of idling and that of the fresh conveying sheet are plotted in FIG. 8.

Figure 8A:
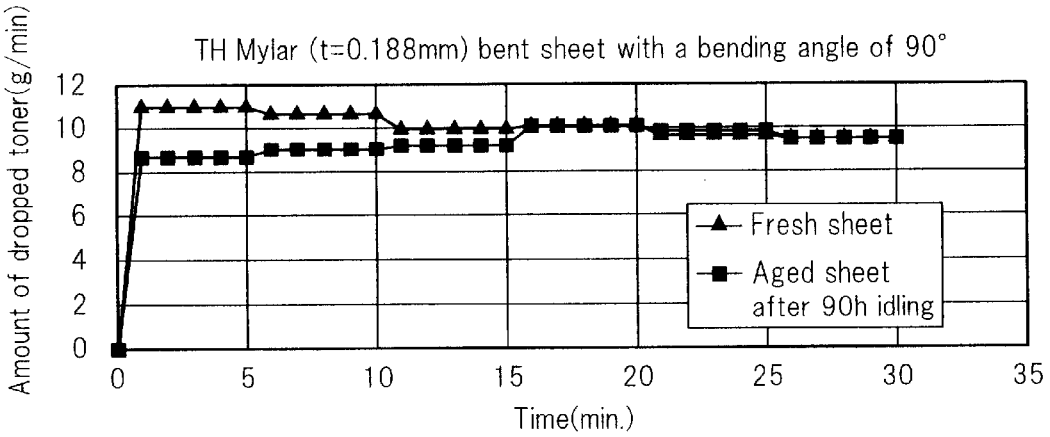
FIGS. 8A to 8C show the characteristic charts of the result of toner replenishment of a toner replenishing device of the first embodiment of the present invention, where the angle of bent portion is varied.
Figure 8B:
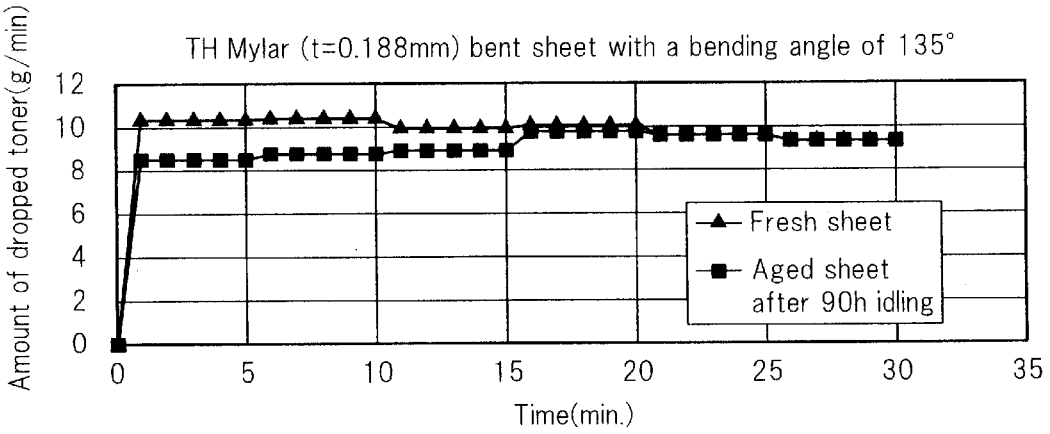
Figure 8C:
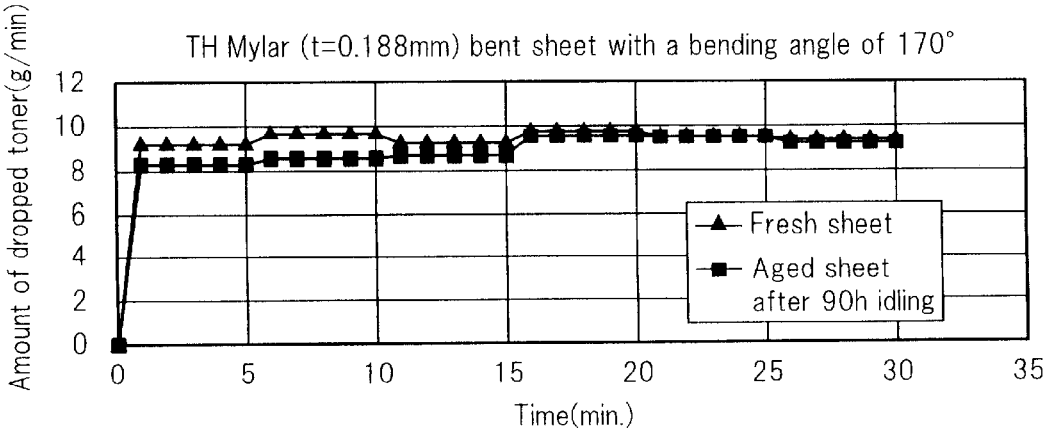

Specifically, as in a similar manner to the case of FIG. 7B, with a determined amount of the toner charged in reserve container 50, a conveying sheet 58 with which agitator 57 has been continuously rotated for 90 hours (represented with ■ in the chart) and a fresh conveying sheet (represented with ▲ in the chart) were evaluated by plotting the supplied amount of toner to developing hopper 51 along the vertical axis and the time of rotation (min.) of the conveying sheet after idling and the fresh sheet along the horizontal axis. The amount of dropped toner in the characteristic charts indicates the supplied amount of toner to developing hopper 51. FIG. 8A is the case where the bending angle α was set at 90°, FIG. 8B is the case where the bending angle α was set at 135° and FIG. 8C is the case where the bending angle α was set at 170°.

As shown in FIG. 8, with all the angles there was little difference in the amount of dropped toner or the supplied amount between the fresh one and that aged after a long idling. Particularly, no significant difference in toner supplied amount was found around 15 minutes and thereafter. This indicates that the toner supplied amount will be kept constant continuously after 15 minutes so as to make stable replenishment in the long term with a beneficial toner conveyance.

Though not shown in FIG. 8, the same evaluation has been made for the cases other than above where a bending angle α of bent portion 58*a* was smaller than 90° or the sheet was bent with an acute angle and where the bending angle was set at 175°. When the angle α was set smaller than 90°, the regidity of conveying sheet 58 could be secured but the toner conveyance was lowered presenting a sharp reduction of the toner supplied amount.

When the bending angle α of conveying sheet 58 was set at 175°, the sheet was bent and deformed by its contact with the wall of the toner reserve container and the resistance from the toner, similarly to the conventional conveying sheet, around the fixed portion 'd' to the agitator as shown in FIG. 6, causing whitening after a long use, presenting degradation of toner conveyance.

In conclusion, the angle α with which conveying sheet 58 of the present invention has been bent beforehand at bent portion 58*a*, should be set so that $90° \leqq \alpha \leqq 170°$, to produce a beneficial result. From the result shown in FIG. 8, when the sheet was bent at a bending angle α of 170° or its proximity on the smaller angle side, a very good result was obtained. Actually, when the bending angle α was set at an angle within the range of 140° to 170°, the optimal result was obtained. It is conceived that setting the angle at bent portion 58*a* within this range is most effective in absorbing and relieving the curving and deformation of conveying sheet 58 while it is rotated. When the angle α is set at an angle smaller than 90°, the deformation of the conveying sheet about bent portion 58*a* in the left and right directions in FIG. 5 becomes large and hence the deflecting amount of the conveying sheet attached to agitator 57 becomes large. Thus, it is conceived that bending deformation and whitening occur.

The degree of the effectiveness of bent portion 58*a* of conveying sheet 58 varies depending upon the position thereof. Next, the position of bent portion 58*a* at which conveying sheet 58 is bent will be described.

(Concerning the Position of Bent Portion 58*a* of Conveying Sheet 58)

In the description heretofore, the suitable range of bending angle α of conveying sheet 58 attached to agitator 57 has been specified. The effect of the bent portion can be enhanced by appropriately specifying the position of bending as described hereinbelow.

If bent portion 58*a* is formed near the attached position of conveying sheet 58 with agitator 57, the distance between bent portion 58*a* and the fixed end on agitator 57 is too short. Therefore, when conveying sheet 58 is deformed, the deforming load concentrates on the fixed portion so that elastic breakdown occurs or the sheet will not revert itself back to its original shape. On the other hand, if the bent portion is formed at a position rather distant from the fixed position of conveying sheet 58 or on the free end side of the conveying sheet, the benefit with provision of bent portion 58*a* cannot be expected. This simply yields the same result as that of the conventional configuration.

Accordingly, bent portion 58*a* should be formed at a halfway point of conveying sheet 58, and more especially in the middle of it. Since the length of conveying sheet 58 is determined dependent upon the dimensions of toner reserve container 50, the position of the bent portion should be determined in conformity with the dimensions. Further, since conveying sheet 58 is attached and fixed to agitator 57, the length should be determined dependent on the dimensions involving the attached position and toner reserve container 50.

Since the length of conveying sheet 58 is determined dependent on its attached position and the dimensions of toner reserve container 50, the position of bent portion 58*a* of conveying sheet 58, i.e., the distance h from the attachment edge 'd' of agitator 57 to bent portion 58*a* may and should be determined in relation with the shortest distance H from the bottom of toner reserve container 50 to agitator 57, as shown in FIG. 2. FIG. 9 shows the result from the experiments shown below to specify the relationship between h and H. As understood from FIG. 9, it is effective that the distance h of bent portion 58*a* is set at a value within the range of $(H/4) \leqq h \leqq (2H/3)$.

FIG. 9 shows the results of plotting by varying the distance h for representing the position of bent portion 58*a* of conveying sheet 58 relative to the aforementioned distance H. More clearly, with the dimensions of toner reserve container 50 and those of agitator 57 fixed, the distance h of bent portion 58*a* of conveying sheet 58 was varied to evaluate toner agitation and conveyance.

Figure 9A:
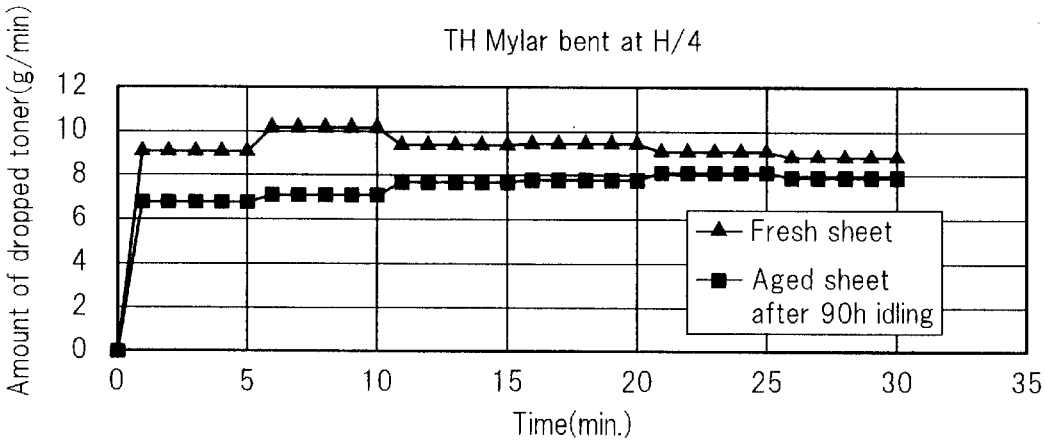
FIGS. 9A to 9C show the characteristic charts of the result of toner replenishment of a toner replenishing device of the first embodiment of the present invention, where the position of the bent portion of the conveying sheet relative to the toner reserve container is varied.

FIG. 9A shows the graph when the distance h of bent portion 58*a* of conveying sheet 58 was set equal to H/4 where H is the shortest distance from agitator 57 to toner reserve container 50. That is, bent portion 58*a* was formed closer to the attachment edge of agitator 57. In this case, the supplied amount of toner by the conveying sheet 58 after 90 hours of idling and aging and that of the fresh conveying sheet 58 were compared. The result showed little difference. From this result, it is understood that the conveying performance was maintained much better than the conventional configuration shown in FIG. 7A. Though not shown in FIG. 9, the case where bent portion 58*a* was formed at a position equal to H/5, it was found that there was a significant difference in toner supplied amount between the two. This is attributed to the fact that bent portion 58*a* was positioned closer to the attachment edge of agitator 57.

Figure 9B:
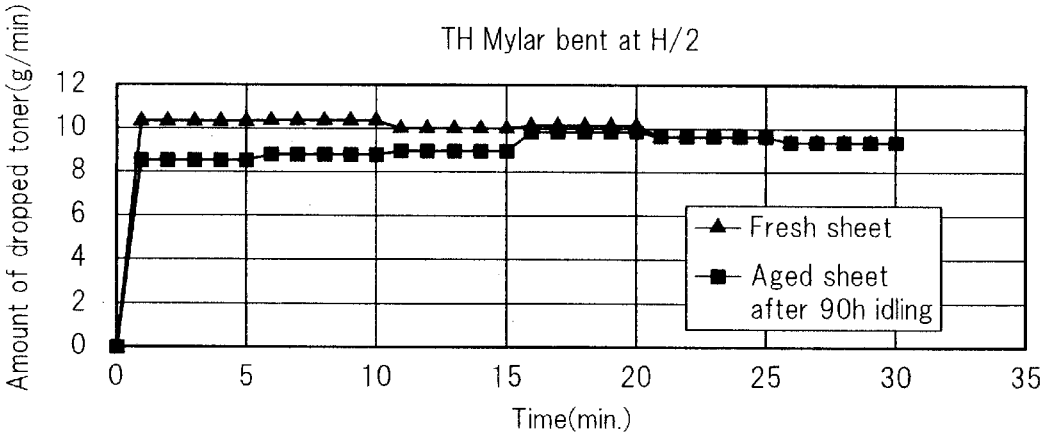
Figure 9C:
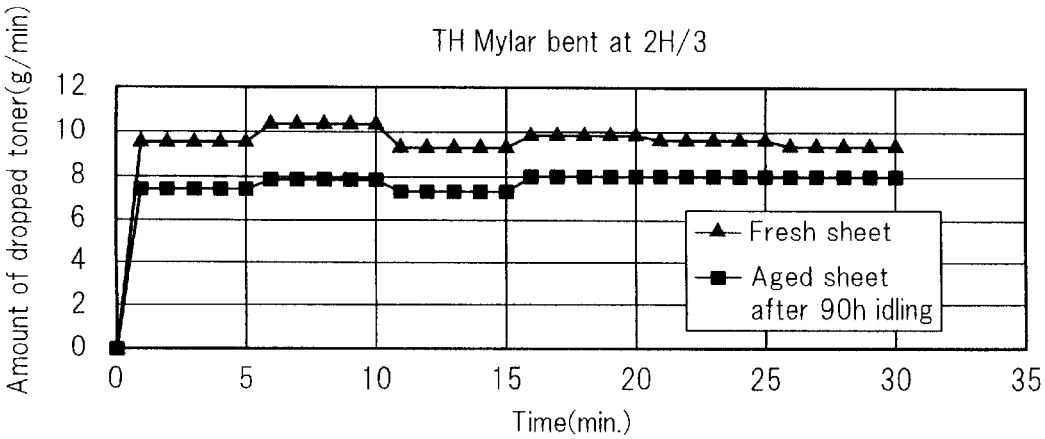

FIG. 9C shows the graph when the distance h of bent portion 58*a* of conveying sheet 58 was set equal to 2H/3. From this result, it is understood that the toner supplied amount was maintained for a long time. Though not shown in FIG. 9, the case where the distance h of bent portion 58*a* was set at a position equal to 3H/4, it was found that there was some difference in toner supplied amount between the conveying sheet 58 after 90 hours of idling and aging and the fresh conveying sheet 58. This is attributed to the fact that bent portion 58*a* was positioned closer to the distal end of conveying sheet 58.

Accordingly, the position of bent portion 58*a* of conveying sheet 58, i.e., the distance h from the attachment edge of agitator 57 to bent portion 58*a* may and should be determined to fall within the range of $(H/4) \leqq h \leqq (2H/3)$ where the distance H is from the bottom of toner reserve container 50 to agitator 57. This setting provides stable toner supply in the long term. Needless to say, the effect of this specification is further enhanced by setting the bending angle α of conveying sheet 58 within the aforementioned range.

The distance H from the bottom of toner reserve container 50 to agitator 57 end was set to be at least 20 mm or greater.

(The Relationship Between the Thickness of Conveying Sheet 58 and the Position of Bent Portion 58*a*)

It was discussed in the above description that as the requirement for forming bent portion 58*a* of the present invention, the aforementioned position of forming bent portion 58*a*, i.e., the distance h is determined dependent upon the distance H from the bottom of toner reserve container 50 to agitator 57, which is related to the dimensions of the toner reserve container. However, not limited to this, the distance h, the position of bent portion 58*a*, can be determined in accordance with the thickness t of conveying sheet 58 used.

Actually, the rigidity of conveying sheet 58 is affected by its thickness t. The thicker the conveying sheet 58, the more the rigidity increases. This, however, also increases the load when the sheet is rotated as is in contact with the inner wall surface of toner reserve container 50. If the sheet is deformed greatly, the sheet may have whitening due to elastic breakdown and bending deformation. In contrast, if the sheet is made thinner, this reduces the possibility of breakdown and bending deformation but also lowers the toner conveyance.

Now, the determined result of the proper value that specifies the position of bent portion 58*a* of conveying sheet 58 in accordance with the thickness t of conveying sheet 58 will be described hereinbelow. Also in this case, if bent portion 58*a* is formed near the attachment edge of agitator 57, the distance between bent portion 58*a* and the fixed end d on agitator 57 is too short. Therefore, when conveying sheet 58 is deformed, the deforming load concentrates on the fixed portion so that elastic breakdown occurs or the sheet will not revert itself back to its original shape. On the other hand, if the bent portion is formed at a position rather distant from the fixed position of conveying sheet 58 or on the free end side of the conveying sheet, the benefit with provision of bent portion 58*a* cannot be expected. This simply yields the same result as that of the conventional configuration.

The position of bent portion 58*a* is determined as appropriate, dependent on the length of conveying sheet 58 and the dimensions of toner reserve container 50 and also should be determined in accordance with the thickness t of conveying sheet 58. Particularly, if the thickness t of conveying sheet 58 is made greater, the distance h from the attachment edge of agitator 57 should be set greater. If the thickness t is small, the distance h should be set smaller compared to that in the thick configuration.

FIG. 10 shows the results of plotting by varying the distance h for representing the position of bent portion 58*a* of conveying sheet 58 relative to the thickness t of conveying sheet 58. More clearly, with the dimensions of toner reserve container 50 and those of agitator 57 fixed, the distance h of bent portion 58*a* of conveying sheet 58 was varied to evaluate toner agitation and conveyance.

Figure 10A:
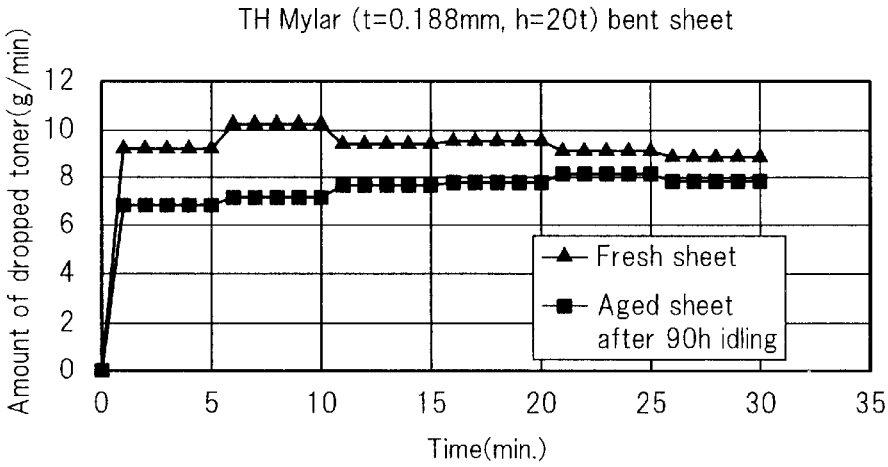
FIGS. 10A to 10C show the characteristic charts of the result of toner replenishment of a toner replenishing device of the first embodiment of the present invention, where the thickness of the conveying sheet and the position of the bent portion are varied.
Figure 10B:
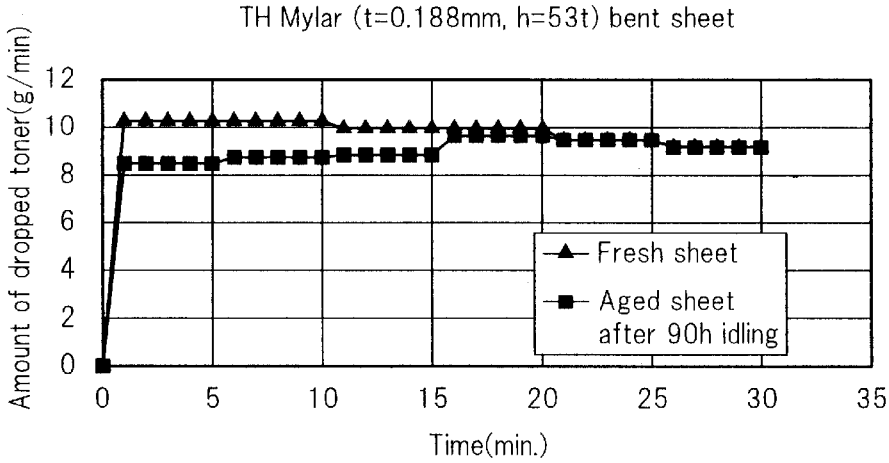
Figure 10C:
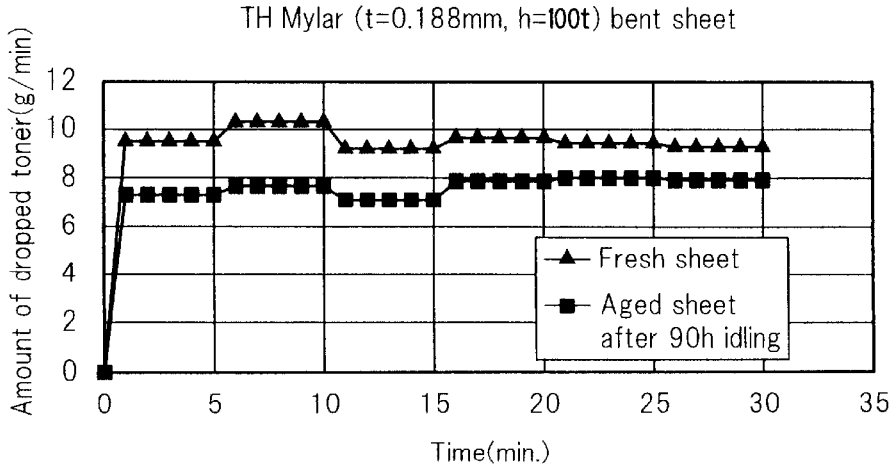

FIG. 10A shows the graph when the distance h of bent portion 58*a* of conveying sheet 58 was set 20 times as much as the thickness t of conveying sheet 58, where t was set 0.188 mm. This is the case where bent portion 58*a* was formed nearby the attached portion with agitator 57. FIG. 10B and 10C are the cases where the distance h was set 53 times and 100 times of the thickness 't' (=0.188 mm) of the conveying sheet 58, respectively.

Particularly, in comparison of the toner supplied amount of the conveying sheet 58 after 90 hours of idling and aging with that of the fresh conveying sheet 58, the configuration where the distance h was set 53 times of the thickness t showed little difference. Even in the case where the distance was set 20 times or 100 times of the thickness t, it was found the conveying performance was markedly improved compared to the result of the conventional configuration shown in FIG. 7A and hence stable conveyance could be maintained.

Though not shown in FIG. 10, the case where bent portion 58*a* was formed at a position equal to about 10t, it was found that there was a large difference in toner supplied amount. This is attributed to the fact that bent portion 58*a* was positioned too closer to its attached position with agitator 57. Though this is also not shown in FIG. 10, in the case where the distance h of bent portion 58*a* of conveying sheet 58 was set at a position equal to greater than 101t, it was found that there was some difference in toner supplied amount between the conveying sheet after 90 hours of idling and aging and the fresh conveying sheet. This is also attributed to the fact that bent portion 58*a* was positioned closer to the distal end of conveying sheet 58.

Accordingly, when the position of bent portion 58*a* of conveying sheet 58, i.e., the distance h is determined so as to fall within the range of $20t \leqq h \leqq 100t$ where t is the thickness of sheet 58, it is possible to keep the toner supplied amount at a stable level in the long term. Needless to say, the effect of this specification is further enhanced by setting the bending angle a of conveying sheet 58 within the aforementioned range.

The distance H from the bottom of toner reserve container 50 to agitator 57 end was set to be about 20 mm.

Figure 11:
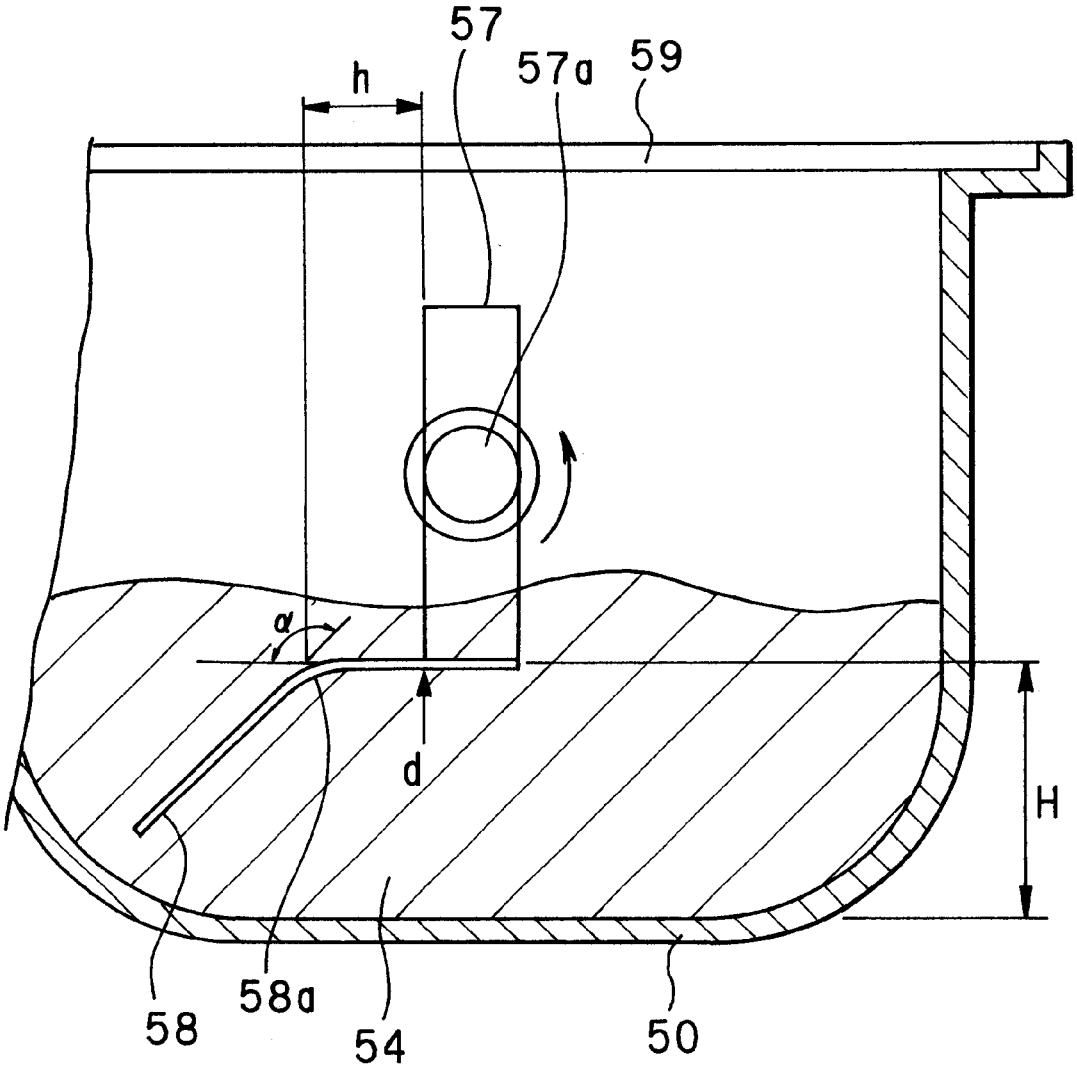
FIG. 11 is a sectional view showing another embodiment of a conveying sheet of a toner replenishing device in accordance with the first embodiment of the invention.

In the above description, conveying sheet 58 is bent at a halfway point thereof, forming a bent portion 58*a* with its bending angle $\alpha$ set at a predetermined value. However, the same effect can be attained by providing a curved portion 58*a* as shown in FIG. 11, instead of forming a bent portion as above. In this case, the angle $\alpha$ is designated as shown in the figure. Specifically, the angle formed between the two planes forming curved portion 58*a* is defined as the angle $\alpha$. The distance h from curved portion 58*a* to the attachment edge 'd' of agitator 57 is defined as that from the center of the curved portion to the attachment edge.

The Second Embodiment of the Present Invention

The above embodiment of the present invention is the case where bent portion 58*a* is formed at a halfway point of conveying sheet 58 in order to suppress the part of conveying sheet 58 joined to the attachment edge of agitator 57 from whitening due to repeated rotation for toner conveyance over a long period of time and to continuously secure stable toner conveyance.

The second embodiment is another configuration for eliminating the same problem without bending conveying sheet 58 at a halfway point. The configuration of the conveying sheet 58 of this embodiment will be detailed hereinbelow.

Figure 12:
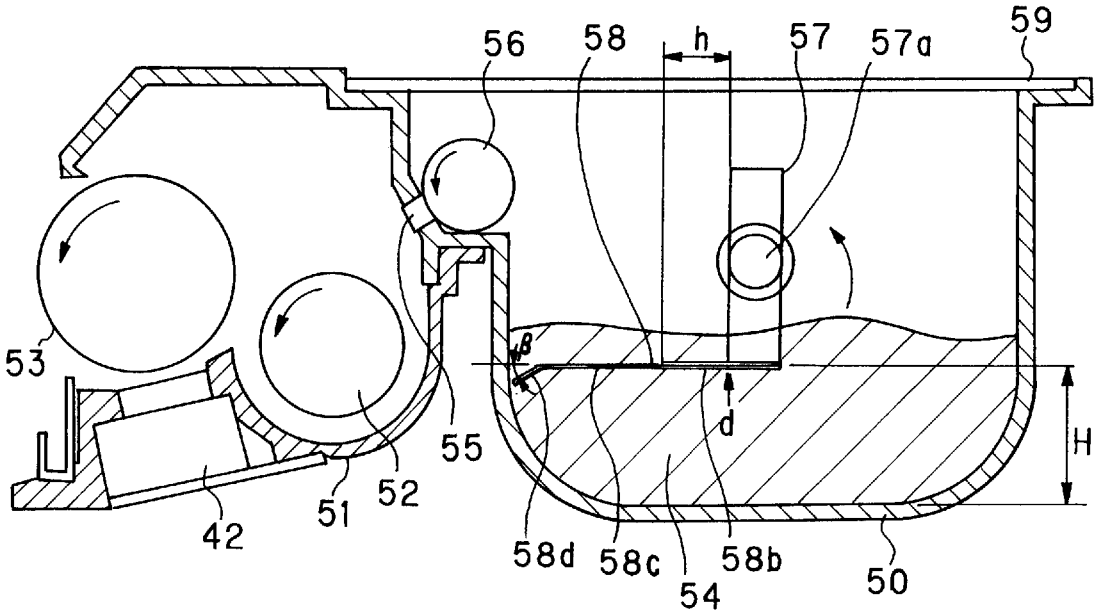
FIG. 12 is a sectional view showing a structure of a developing unit equipped with a toner replenishing device in accordance with the second embodiment of the invention.

FIG. 12 shows an example of the second embodiment of the present invention. This embodiment is completely the same as that shown in FIG. 2 and 3 and FIG. 11 except in the structure of conveying sheet 58. Therefore, only the structure of conveying sheet 58 will be explained in the following description.

In FIG. 12, conveying sheet 58 is configured of a thicker proximal part which is attached to agitator 57 and a thinner free end part for agitating and conveying toner 54 in toner reserve container 50. More specifically, conveying sheet 58 is composed of a fixed part 58*b* to be attached and fixed and a conveying part 58*c* on the free end side and the thickness t1 of fixed part 58*b* is made greater than the thickness t2 of conveying part 58*c* (t1>t2).

With conveying sheet 58 having the above structure, it is possible to agitate the toner in toner reserve container 50 by rotating agitator 57 and scoop up the toner using the conveying part 58*c* and feed the toner to the toner replenishing roller 56 side. During this operation, conveying sheet 58 deforms due to resistance acting on the sheet when the sheet scoops up the toner, that is, due to resistance of the weight and viscosity of the toner. In this case, the sheet is deformed greatly in the direction opposite to the direction of rotation, in particular, greater on the conveying part 58*c* side. Therefore, the deformation at the part of conveying sheet 58 joined to the attachment edge 'd' of agitator 57 is suppressed so that plastic deformation of conveying sheet 58 with the passage of time can be inhibited. This means that conveying sheet 58 is prevented from whitening in fixed part 58*b* at the attachment edge 'd' and becoming unable to revert itself back to the original state.

Similar to those shown in FIG. 2 and 3, the influence on the part of conveying sheet 58 joined to the attachment edge of agitator 57 can be negated by conveying portion 58*c*, as shown in FIG. 5 so that plastic deformation at the attachment edge 'd' is prevented to continuously provide stable conveyance. A high enough rigidity of conveying sheet 58 can be assured by the fixed part 58*b* side so that it is possible to provide sufficient agitation and conveyance of the toner.

The conveying performance of conveying sheet 58 of the second embodiment of the present invention was evaluated by experiment and compared to that of the conventional conveying sheet shown in FIG. 1. Here, the conventional conveying sheet 68 was configured using a polyester film having a uniform thickness of 0.188 mm.

The conveying sheet 58 of the present invention was composed of fixed portion 58*b* with its thickness t1 set at 0.188 mm and conveying portion 58*c* with its thickness t2 set at 0.125 mm.

The experimental result obtained is almost the same as that obtained in the first embodiment, shown in FIG. 7. The comparison was made by plotting graphs of toner conveyance of a fresh conveying sheet and an conveying sheet after 90 hours of idling and aging, as described above. The result of the conventional conveying sheet is that shown in FIG. 7A. That is, the identical configuration used in the description of the first embodiment was used as the conventional configuration. The result of conveying sheet 58 of the second embodiment of the present invention was approximately equivalent to that shown in FIG. 7B.

Accordingly, the conveying sheet 58 of the second embodiment of the present invention, which is configured of fixed portion 58*b* and a conveying portion 58*c*, can also provide high enough toner conveying and agitating performances, to thereby achieve stable toner conveyance. For the long term use, deformation of conveying sheet 58 at the attachment edge of agitator 57 is inhibited so that it is possible to prevent the loss of recovery of the deformation.

In conveying sheet 58 of the second embodiment of the present invention, it has been found that the position of the stepped portion where fixed portion 58*b* is connected to conveying portion 58*c* is approximately equivalent to that of bent portion 58*a* of the first embodiment. Illustratively, the distance h from the attached position 'd' of fixed portion 58*b* with agitator 57 to the step where it joins to conveying portion 58*c* is shown in FIG. 12. For this distance h and the distance H from the bottom of toner reserve container 50 to the edge of agitator 57 (the attached position of the conveying sheet), almost the same result as to toner conveyance as that shown in FIG. 8 was obtained.

Actually, with the conveying sheet 58 having the configuration according to the second embodiment, for the depth H of toner reserve container 50 relating to the toner storage amount, when 'h', which is defined the distance from the attached position 'd' of fixed portion 58*b* to the end of fixed portion 58*b*, fell within the range of $(H/4) \leqq h \leqq (2H/3)$, preferred result could be obtained.

As illustrated in the first embodiment, when the distance 'h' was set so as to fall out of the above range, the result showed poor conveyance due to plastic deformation of conveying sheet 58 or other reasons. In this case, when the distance 'h' was short (shorter than H/4), whitening was observed at the step instead of the part of conveying sheet 58 joined to the attachment edge of agitator 57. When the distance 'h' was long (longer than 2H/3), the conveyance was markedly degraded without receiving any effect of the provision of conveying portion 58*c*.

(The Fabrication Method of the Conveying Sheet in the Second Embodiment)

To fabricate conveying sheet 58 having the structure shown in FIG. 12, it is possible to easily produce a stepped molding having a stepped portion partway by injection molding using a film-like material. This method enables provision of an integrated structure for conveying sheet 58.

Instead, it is also possible to produce the conveying sheet by laminating a second sheet or sheets on one or both sides of a first thin sheet so that the second sheet corresponds to fixed portion 58*b* while the single layered portion corresponds to conveying portion 58*c*. In this configuration, a plurality of sheets only need to be joined and pasted in layers, to enable simple fabrication.

As the raw material for forming conveying sheet 58, a material presenting sufficient flexibility such as polyester, polyethylene terephthalate (PET) and the like, as mentioned above, can be selected.

The joining of agitator 57 and conveying sheet 58 is typically made applying a double-sided tape or an adhesive etc. However, in some cases depending upon bonding methods, the size of the joint areas, or surrounding conditions, there is a possibility that conveying sheet 58 might partially peel off from agitator 57 and become separated therefrom, resulting in failures to agitate and convey the toner.

To deal with this, it is possible to form agitator 57 and conveying sheet 58 as a single-piece integrated part. For this molding, an injection molding technique can be used as mentioned above. Use of this eliminates the peeling problem. In this case, in order to prevent the attached part of conveying sheet 58 joined to the attachment edge of agitator 57 (at the point 'd' in FIG. 5) from being deformed and whitened during agitation and conveyance, the aforementioned bent portion 58*a* or the stepped configuration of the fixed portion 58*b* and conveying portion 58*c* is formed in accordance with the first or second embodiment of the present invention.

This integration can eliminate dimensional variations derived from the joining of conveying sheet 58 to agitator 57 and enhance the dimensional accuracy, hence realizing improved, stable conveyance of the toner.

Further, recent advances in the field of injection molding have made it possible to perform simultaneous integral molding of two or more kinds of materials in a single mold. One of such techniques called the DSI (die-slide injection) technique has made it possible to partially use different materials within a single part, depending upon the functions.

Based on this technique, it is possible to configure the integrated molding by forming the distal area at the free end of conveying sheet 58 which rotates as sliding along the inner wall of toner reserve container 50 using a material having a good slidability, e.g., Vespel etc, and forming agitator 57 and part of conveying sheet 58 using a material unlikely to be plastically deformed with a relatively high elasticity, such as polyacetai (POM) , the aforementioned PET, or polypropylene(PP). Thus, it is possible to continuously stabilize the conveyed amount of the toner.

Alternatively, it is also possible to form the integrated molding by forming the base part or agitator 57 using ABS (acrylonitrile-butadiene-styrene) resin or PS (high-impact polystyrol) resin in order to provide bending strength and torsion strength and forming conveying sheet 58 which should have elasticity for curving, using a material such as POM, PET, PP or the like having lower bending and torsion strengths than agitator 57. With this selection, it is possible to stabilize the conveyed amount of the toner and realize continuously stable toner conveyance.

The Third Embodiment of the Present Invention

The conveying sheet 58 explained in the second embodiment is-configured of fixed portion 58*b* to be fixed to agitator 57 and conveying portion 58*c*. This fixed portion 58*b* serves as reinforcement for securing the rigidity of conveying sheet 58. That is, this is a reinforcing element which fixes the sheet to agitator 57 and prevents the fixed end 'd' from being bent and whitened, and inhibits deformation of conveying sheet 58 to maintain toner conveyance.

The third embodiment is the invention which provide further improved toner conveyance and enables further long termed use of the conveying sheet compared to that achieved by fixed portion 58*b* of the second embodiment. The detail will be made hereinbelow.

Figure 13A:
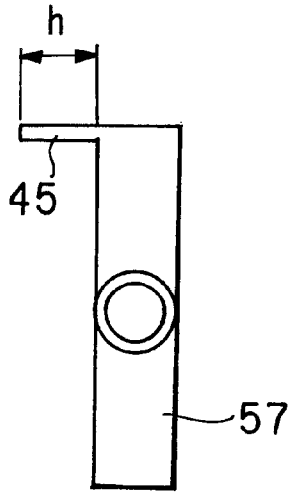
FIGS. 13A to 13D are plan views showing various examples of reinforcing elements for securing the rigidity of the conveying sheet in a developing unit equipped with a toner replenishing device in accordance with the third embodiment of the present invention.

FIG. 13A to 13D show various examples of reinforcing elements 45 provided for securing sufficient rigidity of conveying sheet 58 to reinforce conveying sheet 58. FIG. 13A shows an example of a reinforcing element 45, corresponding to fixed portion 58*b* of conveying sheet 58, integrally molded with agitator 57 as explained before. This reinforcing element 45 is used to bond conveying sheet 58 thereto.

With this configuration, conveying sheet 58 is reinforced with reinforcing element 45 to have necessary rigidity, thus achieving improved toner conveyance. Further, this configuration of conveying sheet 58 also prevent a large plastic deformation around the attachment edge 'd' of agitator 57 shown in FIG. 5, and hence inhibits whitening at that area, thus enabling a long term use. Particularly, since reinforcing element 45 is integrally molded with agitator 57, there is no risk of the reinforcing element being removed from agitator 57.

Figure 13B:
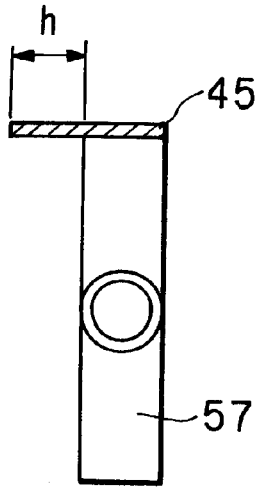
Figure 13C:
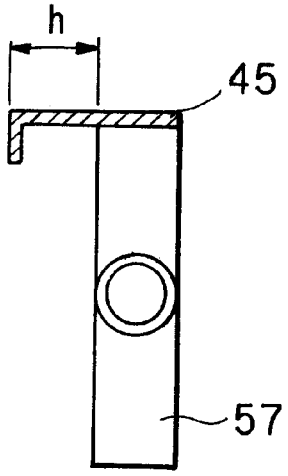
Figure 13D:
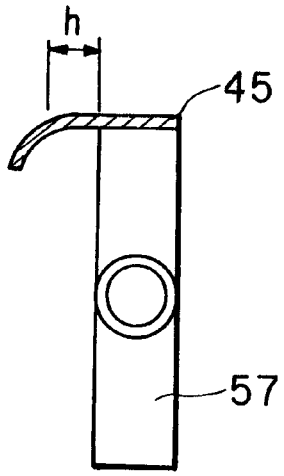

FIG. 13B through 13D show configurations in which a flat-shaped reinforcing element 45 is bonded to one end of agitator 57. Particularly, the reinforcing element 45 shown in FIG. 13B is of a mere flat plate; the reinforcing element 45 shown in FIG. 13C is a flat plate with its distal end angled 90°; and the reinforcing element 45 shown in FIG. 13D is a flat plate with its distal end curved. Needless to say, the reinforcing elements 45 shown in FIG. 13C and 13D may be formed integrally with agitator 57, instead of bonding.

Each of reinforcing elements 45 shown in FIG. 13B to 13D is bonded to agitator 57 and conveying sheet 58 is bonded to the reinforcing element 45 so as to construct a conveying and agitating means of the toner in toner reserve container 50. Particularly, this means is rotated about shaft 57*a* of agitator 57 in toner reserve container 50 shown in FIG. 2, FIG. 3 and FIG. 12, to thereby perform toner conveyance and agitation with conveying sheet 58.

With each of the reinforcing elements 45 shown in FIG. 13B to 13D, the same operation effects as that shown in FIG. 13A can be obtained. Further, since reinforcing element 45 is bonded to agitator 57, the element 45 need not be formed of the same material as agitator 57, so that any material having a rigidity suited to conveying sheet 58 can be used.

Referring next to FIG. 14, the attachment of reinforcing element 45 shown in FIG. 13B to 13D and conveying sheet 58 to agitator 57 will be described. In FIG. 14, the example is shown using that shown in FIG. 13C, but those shown in FIGS. 13B and 13D can also be bonded in the same manner.

As described heretofore, agitator 57 is configured of a pair of supporting plate 57*b* fixed on both ends of rotary shaft 57*a* and a pair of agitating bars (agitating plates) 57*c* for agitating the toner arranged on both ends of supporting plates 57*b*. Reinforcing element 45 is bonded to one of agitating bar 57*c* with an adhesive or double-sided tape. Similarly, conveying sheet 58 is bonded to the thus bonded reinforcing element 45 using an adhesive or double-sided tape.

As shown in FIG. 14, conveying sheet 58 is bonded to reinforcing element 45 with an area as large as reinforcing element 45 is bonded to agitating bar 57*c* of agitator 57. That is, though reinforcing element 45 is attached to agitating bar 57*c* so that it projects in the direction of rotation of agitator 57, conveying sheet 58 is not bonded to reinforcing element 45 in its projected portion. Illustratively, as shown in FIG. 15, the conveying sheet is bonded by only the hatching with other contact area between reinforcing element 45 and conveying sheet 58, or the projected portion (having a width of h in FIG. 14) of reinforcing element 45, unbonded.

Figure 15A:
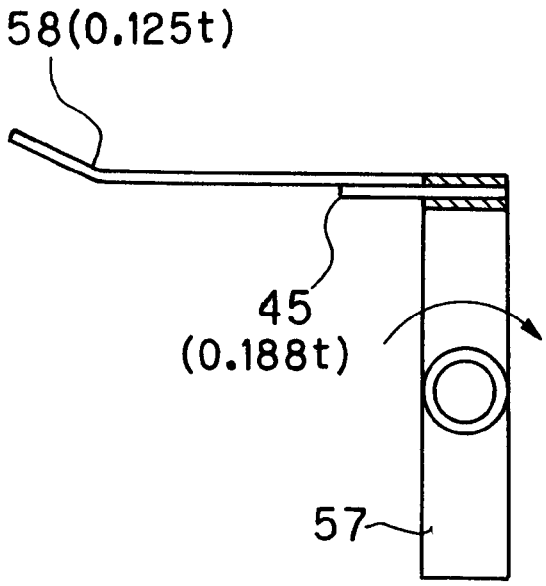
FIGS. 15A and 15B show a proper example of attachment of the reinforcing element and conveying sheet to the agitator in the third embodiment, FIG. 15A being a plan view of the attachment and FIG. 15B being a plan view for illustrating the operating state after attachment.

This situation is also shown in FIG. 15A. That is, the hatching areas are bonded and the overlaid portion other than the hatching areas between reinforcing element 45 and conveying sheet 58 is not bonded or the unbonded area.

Figure 15B:
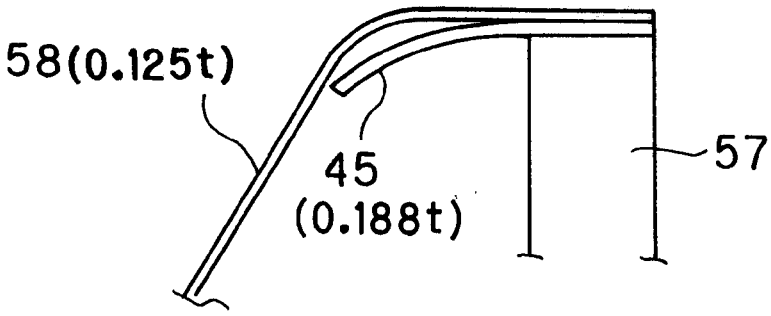

In this arrangement, agitator 57 is rotated while conveying sheet 58 agitates and conveys the toner in the toner reserve container as it deforms in contact with the inner wall surface of the reserve container. During this, since conveying sheet 58 is not bonded to the whole surface of reinforcing element 45, the elasticity of conveying sheet 58 is not inhibited, so that the sheet can deform freely, not being affected by the deformation of reinforcing element 45, as shown in FIG. 15B.

In contrast, when conveying sheet 58 and reinforcing element 45 are formed integrally, or when conveying sheet 58 is bonded to the whole surface of reinforcing element 45, the flexibility of conveying sheet 58 is constrained so that it becomes difficult to disperse the loads acting on conveying sheet 58, causing the risk of occurrence of plastic deformation of conveying sheet 58. Actually, the flexibility of the portion of conveying sheet 58 bonded to reinforcing element 45 is constrained, so that conveying sheet 58 may be bent excessively at the front end of reinforcing element 45, causing plastic deformation and hence whitening at that portion.

As in the present invention, by at least leaving out the projected portion when conveying sheet 58 is bonded to reinforcing element 45, conveying sheet 58 will not be inhibited from deforming and hence prevented from plastic deformation, and can be used in the long term. Further, the rigidity of conveying sheet 58 can be maintained by reinforcing element 45 so as to provide necessary toner conveyance.

Here, in order to maintain the rigidity of conveying. sheet 58, reinforcing element 45 should, if possible, have a higher rigidity than that of the conveying sheet. For this purpose, if reinforcing element 45 and conveying sheet 58 are formed of an identical material, reinforcing element 45 should be made thicker than conveying sheet 58. For example, as shown in FIG. 15, reinforcing element 45 and conveying sheet 58 may be formed to be 0.188 mm and 0.125 mm thick, respectively.

The toner conveying performance of conveying sheet 58 when reinforcing element 45 of the third embodiment was employed was tested. For the test configuration, the reinforcing element 45 shown in FIG. 13B was used and the thicknesses of conveying sheet 58 and reinforcing element 45 were set as shown in FIG. 15. Similar result to FIG. 7B was obtained. In conclusion, use of the reinforcing element 45 makes it possible to provide necessary toner conveyance and prevents plastic deformation of the conveying sheet, allowing the long term use.

(Another Variation of the Reinforcing Element of the Third Embodiment)

Figure 16A:
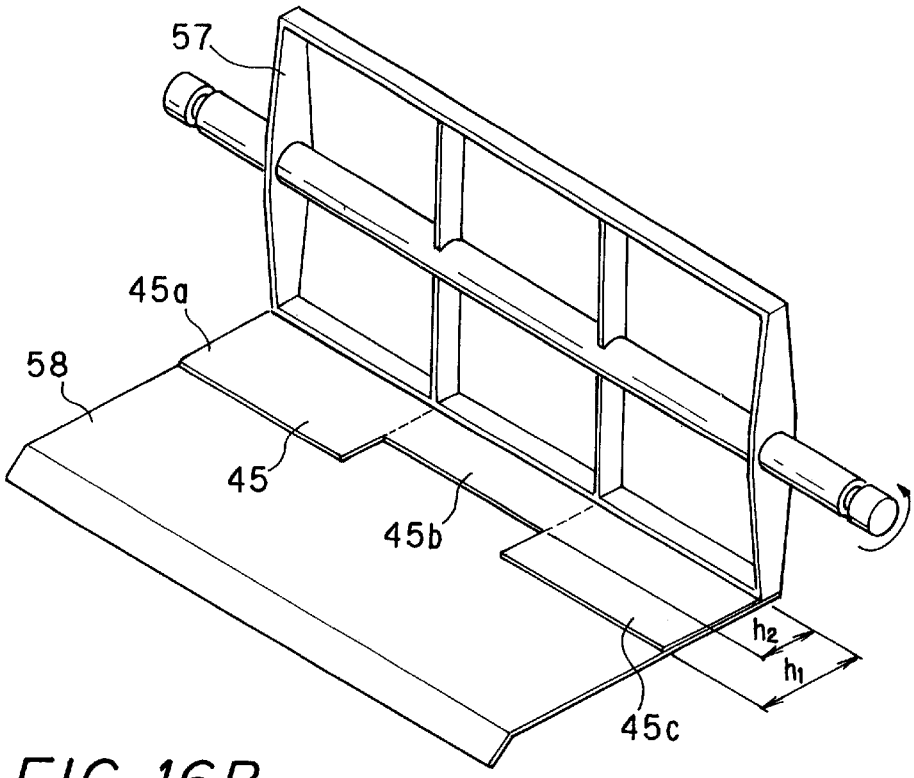
FIGS. 16A and 16B are perspective views showing an example of an improved reinforcement of the conveying sheet with a reinforcing element in accordance with the third embodiment of the present invention.

The reinforcing element 45 having the configuration shown in FIG. 13B is made up of a rectangular (flat-shaped) plate. In general, conveying sheet 58 tends to present lower conveyance at both extremes than the central part across shaft 57*a*. This is because the extreme areas in the longitudinal direction of conveying sheet 58 (across shaft 57*a*) are liable to be deformed compared to the central part. To deal with this, a reinforcing element 45 having greater areas at both extremes than that in the center is formed as shown in FIG. 16A. Specifically, the projected amount of agitator 57 (the width 'h') in both the extremes is made greater than the projected amount 'h' in the center, or hi>h2.

This arrangement inhibits conveying sheet 58 from being deformed excessively at both extremes, thus making it possible to make the distribution of conveyance across the full length of the shaft almost uniform. Thus, both ends of conveying sheet 58 are reinforced by reinforcing element 45, whereby the conveyance at both extremes can be made equal to that in the central part.

In this case, the reinforcing element 45 as shown in FIG. 16A may be formed of a single sheet-like plate or may be formed of the three reinforcing parts 45*a*, 45*b* and 45*c*, the center piece and the side pieces, separated by the broken lines. The divided configuration has the advantage that reinforcing element 45 can be configured by combination of sheets of determined shapes. The integral configuration has the advantage that attachment work to agitator 57 and the number of parts can be reduced. Therefore, either may be selected as appropriate.

Figure 16B:
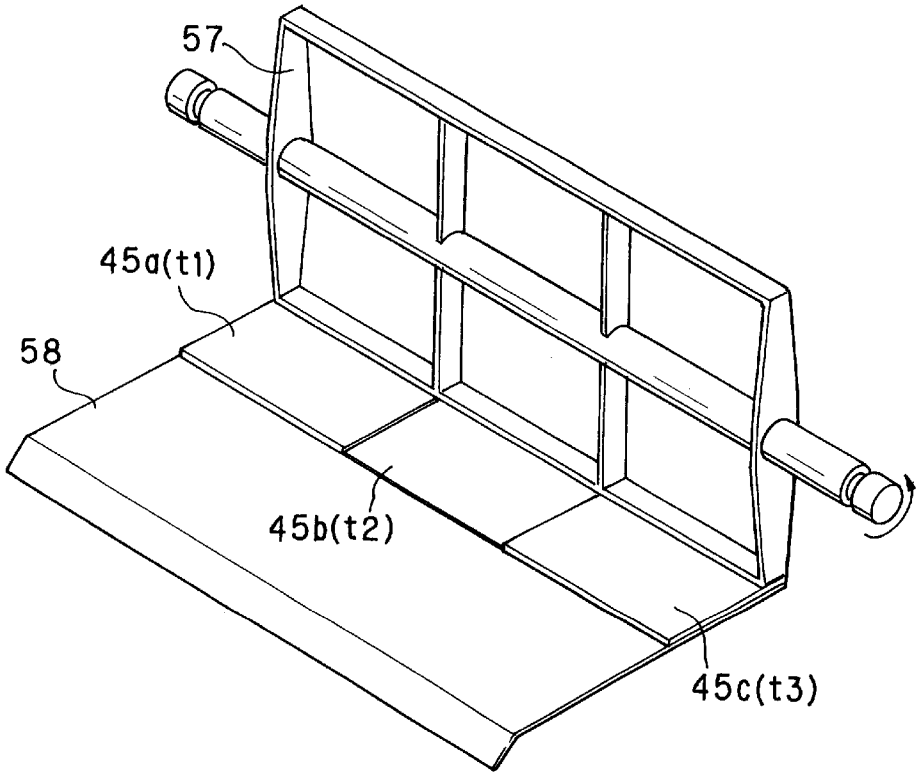

FIG. 16B shows another configuration where the thickness of the reinforcing element in the center is made thinner than that of the reinforcing element at both extremes in order to secure the rigidity at both extremes of conveying sheet 58 and provide uniform distribution of conveyance across the full length of the rotary shaft. Also with the reinforcing element 45 having this structure, it is possible to obtain the same conveyance as that of the reinforcing element 45 having the structure shown in FIG. 16A. Also in this case, the reinforcing element may be formed of an integral molding or may be divided into extremes and center reinforcing pieces, having different thicknesses. Either can be selected as appropriate. Further, the configurations of reinforcing elements 45 shown in FIG. 16A and 16B can be combined. That is, reinforcing parts (45*a* and 45*c*) at both extremes may be formed to have longer projection h and be thicker than the central reinforcing part (45*b*).

In reinforcing element 45 having the structure shown in FIG. 13A or FIG. 13B, the toner conveying performance was evaluated by varying the projected amount from agitator 57 or projected width 'h'. For evaluation, the thickness of reinforcing element 45 was set thicker than that of conveying sheet 58, specifically, those having the thicknesses shown in FIG. 15 were employed.

The toner conveyance was evaluated in relation to the distance(H) from the bottom of toner reserve container 50 to agitator 57, or the depth of toner reserve container 50. The result obtained was the same as that shown in FIG. 9. The obtained specific range of the projected amount h of reinforcing element 45 is equivalent to that of the position (h) of bent portion 58*a* formed on the integral conveying sheet 58 shown in FIG. 2 and 3, or that of the projected amount h of fixed portion 58*b* shown in FIG. 12.

Therefore, reinforcing element 45 is attached to agitator 57 and the projected amount h from the attachment edge of agitator 57 to the front end of reinforcing element 45 should fall within the range of $(H/4) \leqq h \leqq (2H/3)$. In the case of reinforcing element 45 in FIG. 16A, the projected amount h2 of the central reinforcing part 45*b* should be adopted as h.

(A Further Variation of the Reinforcing Element of the Third Embodiment of the Present Invention)

The above-described reinforcing element 45 of the present invention is provided to secure the rigidity of conveying sheet 58 and prevent its plastic deformation. Particularly, the reinforcing element 45 has the same function as that of fixed portion 58*b* of conveying sheet 58 described in the second embodiment but can also present a reinforced effect over and above that.

Now, a further variational example of reinforcing element 45 in the third embodiment will be described in detail. The description is particularly related to the configurations of reinforcing elements 45 shown in FIG. 13C and 13D, and the further modified configurations will be described below.

Figure 17A:
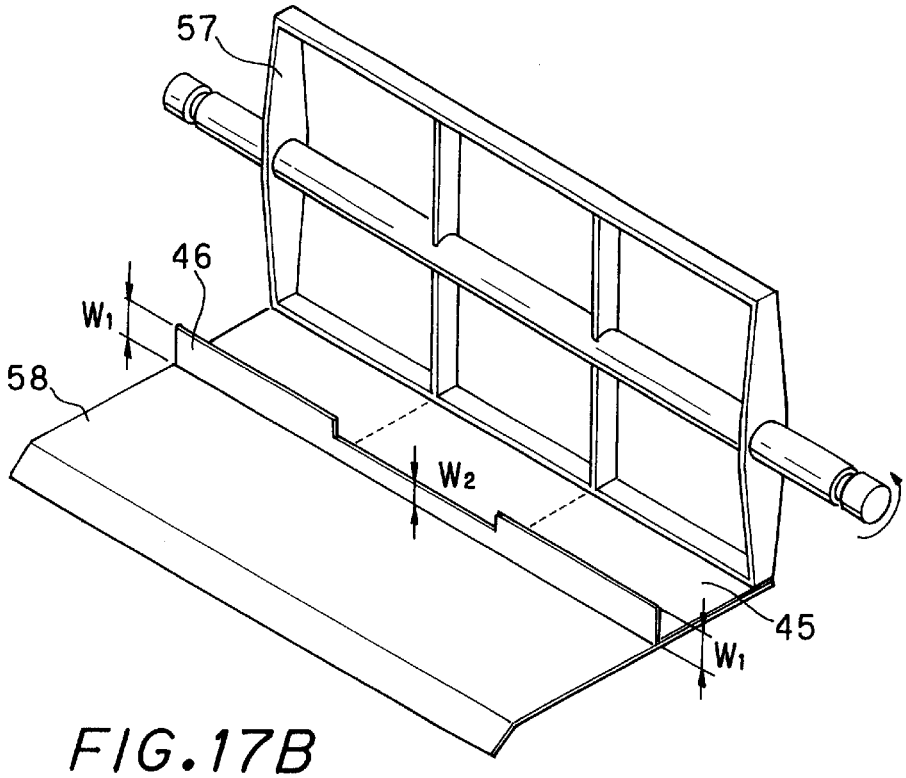
FIGS. 17A and 17B are perspective views showing another example of an improved reinforcement of the conveying sheet with a reinforcing element in accordance with the third embodiment of the present invention.

The reinforcing elements 45 shown in FIG. 17 are related to those explained with reference to FIGS. 13C and 13D. Here, these are the configurational examples to further enhance the rigidity of conveying sheet 58 and maintain the toner conveyance as well as to make the distribution of toner conveyance of conveying sheet 58 across the length of the shaft. First, the reinforcing element 45 having the structure shown in FIG. 17A has a bent end, angled with, for example, about 90° along the rotational direction. The distal end of reinforcing element 45 may be curved as shown in FIG. 13D.

With the distal end of reinforcing element 45 formed of a bent or curved portion, conveying sheet 58 is able to sufficiently agitate the toner stored in toner reserve container 50 and convey the toner well enough. Though conveying sheet 58 deforms as it abuts the inner wall surface of toner reserve container 50, the deformed conveying sheet 58 is supported by reinforcing element 45 so as to provide necessary toner conveyance while keeping its rigidity. During this, the projected, distal part of reinforcing element 45 concentratively supports the deformed conveying sheet 58.

Since the distal end of the reinforcing element 45 in this case is bent or curved so as to enhance the rigidity of the part, it is possible to positively support the deformed conveying sheet 58 and withstand the concentrated loads. As a result, it is possible to provide necessary toner conveyance.

In the above description of the third embodiment, the importance of reinforcing element 45 being thicker than conveying sheet 58 was mentioned. However, the reinforcing element 45 of this configuration as thick as conveying sheet 58 or even thinner than that may provide enough high function as the reinforcement and can secure the necessary toner conveyance.

Also in the configuration of this reinforcing element 45, it is conceived that it might be difficult to secure enough high conveying performance at both extremes of conveying sheet 58 across the length of the rotary shaft as compared to the conveyance at the central part. As stated already, conveying sheet 58 tends to be deformed greatly at both extremes than the central part because of insufficient rigidity of conveying sheet 58 at both extremes. To inhibit the deformation, the reinforcing element 45 with its distal end bent or curved is provided, thus making it possible to uniform the deformation of conveying sheet 58 across the full length of the rotary shaft.

However, if this countermeasure is not good enough, the width W of the distal bent portion of reinforcing element 45 is set greater in both extremes than in the center, as is shown in FIG. 17. Specifically, in FIG. 17A, the width W of the bent portion (or curved portion) 46 of reinforcing element 45 is set so that W1>W2, where W1 is the width at both extremes and W2 is the width in the center.

Figure 17B:
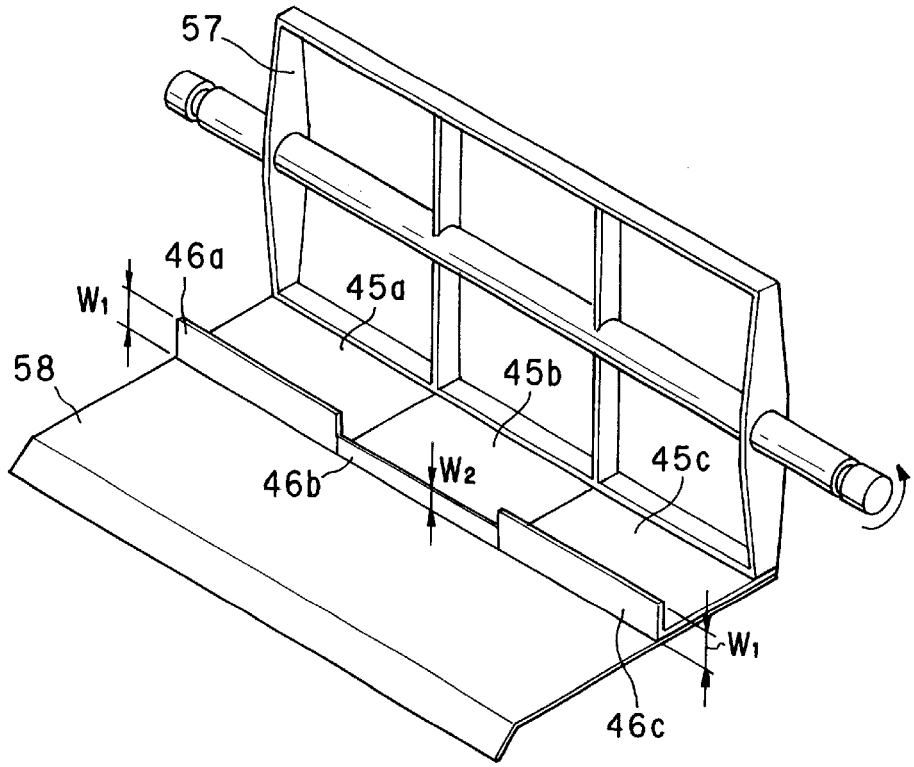

FIG. 17B shows a configuration of reinforcing element 45 where it is divided into three reinforcing parts 45*a*, 45*b* and 45*c* having respective bent portions 46*a*, 46*b* and 46*c* with the width W2 of bent portion 46*b* set smaller than the width W1 of bent portions 46*a* and 46*c*. Either configuration shown in FIG. 17A or FIG. 17B may be selected as appropriate.

In accordance with the above configuration, reinforcing element 45 can positively support the deformation of conveying sheet 58 hence enough high toner conveyance can be obtained. Further, since the width of bent portion 46 of reinforcing element 45 is varied, it is possible to deal with the deformation at both extremes of conveying sheet 58. As a result, it is possible to provide approximately uniform distribution of the toner conveyance by conveying sheet 58 across the full length of the rotary shaft.

When toner conveyance is actually performed with reinforcing element 45 having the structure shown in FIG. 17, it is possible to secure enough high toner conveyance as inhibiting conveying sheet 58 from being plastically deformed as well as to maintain stable toner conveyance over a long period of time. In the above description, the reinforcing element 45 shown in FIG. 17 having a bent portion angled 90° in the rotational direction was taken as the example. However, it is of course possible to obtain the same operation and effect from the configuration having a curved portion shown in FIG. 13D.

In the case where the distal end of reinforcing element 45 is curved, since conveying sheet 58 will deform along the curvature, the effect of inhibiting the conveying sheet from being deflected greatly and hence being plastically deformed can be enhanced. It should be noted that, in the case where the distal end of reinforcing element 45 is curved, the projected amount h is not defined as the distance to the tip of the curvature, but should be defined as the distance up to the start of curvature as shown in FIG. 13D. This is because conveying sheet 58 is curved along the curvature and is supported by the starting point of the curvature.

Instead of the reinforcing element 45 having the structure shown in FIG. 17, FIG. 18 shows a further improved example of reinforcing conveying sheet 58. FIG. 18A shows a corrugated configuration in which the section cut along the longitudinal direction of reinforcing element 45 has a continuous semicircular series; FIG. 18B shows a configuration in which the section has a continuous trapezoidal series; FIG. 18C shows a configuration in which the section has a sinusoidal shape; and FIG. 18D shows a configuration in which the section has a rectangular wave structure. These configurations reinforce the reinforcing elements 45 themselves and provide a sufficient enough function as the reinforcing element even if they are formed of a sheet thinner than conveying sheet 58. In conclusion, each of reinforcing elements 45 shown in FIG. 18A to 18D has a structure having a continuous concavo-convex shape.

The thus configured reinforcing element 45 is bonded to agitating bar 57*c* of agitator 57. Further, on the top of the reinforce element, conveying sheet 58 is bonded as illustrated with reference to FIG. 14. Conveying sheet 58 agitates and conveys the toner in harmony with the rotation of agitator 57, whilst the rigidity of the conveying sheet is assured enough by reinforcing element 45, to thereby maintain stable conveyance. In the configuration of such reinforcing element 45, large deformation at both extremes of conveying sheet 58 can be supported properly so that the conveying sheet can provide uniform distribution of conveyance across the full length of the rotary shaft.

Figure 18A:
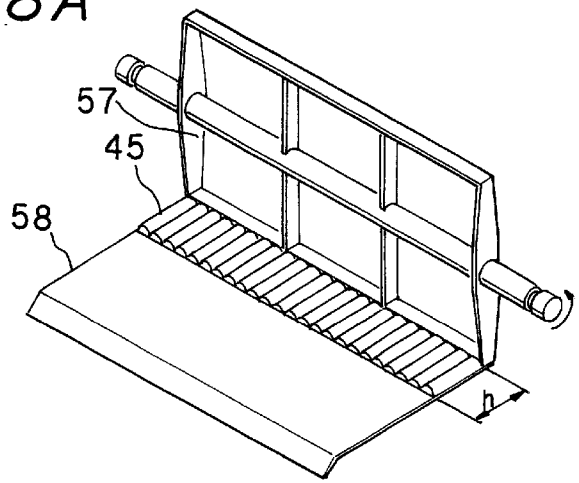
FIGS. 18A to 18D are perspective views showing other configurational examples of reinforcing elements for securing the rigidity of the conveying sheet in a developing unit equipped with a toner replenishing device in accordance with the third embodiment of the present invention.
Figure 18B:
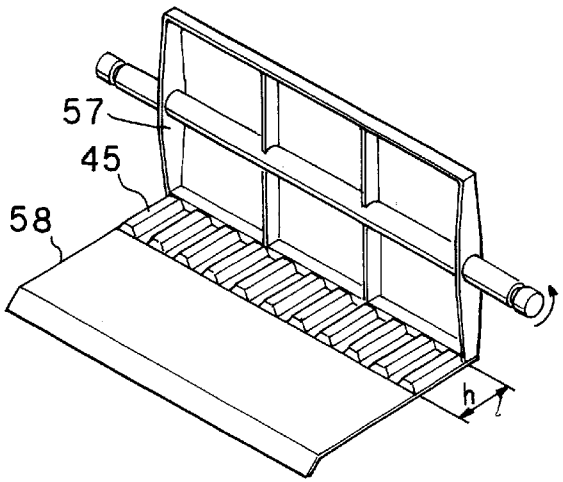
Figure 18C:
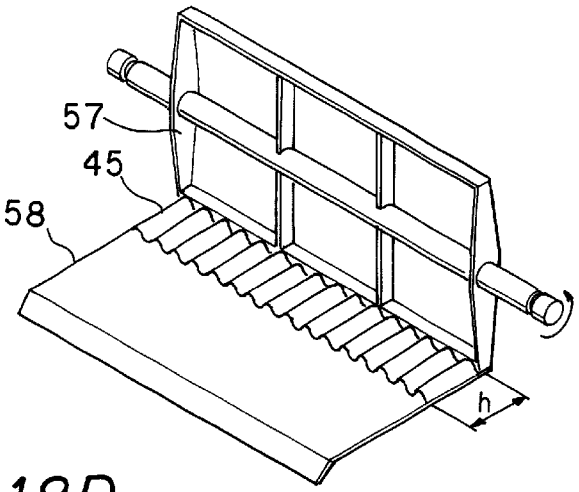
Figure 18D:
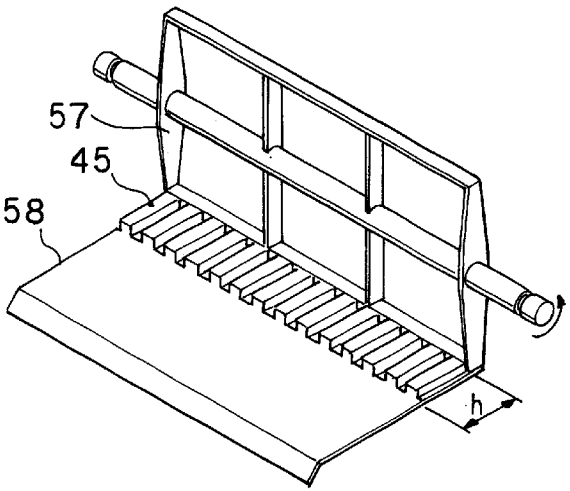
Figure 19A:
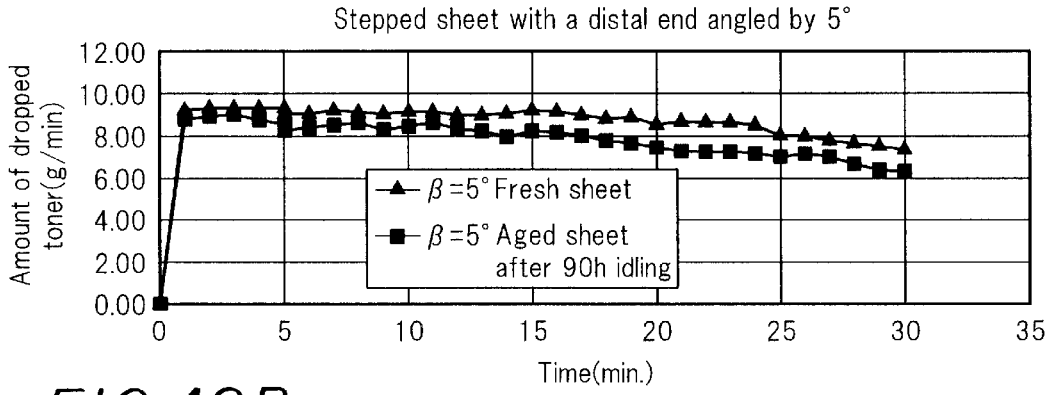
FIGS. 19A to 19D are characteristic charts of toner replenishment of the conveying sheet of the third embodiment of the present invention with its distal end angled at β, where the angle β is varied.
Figure 19B:
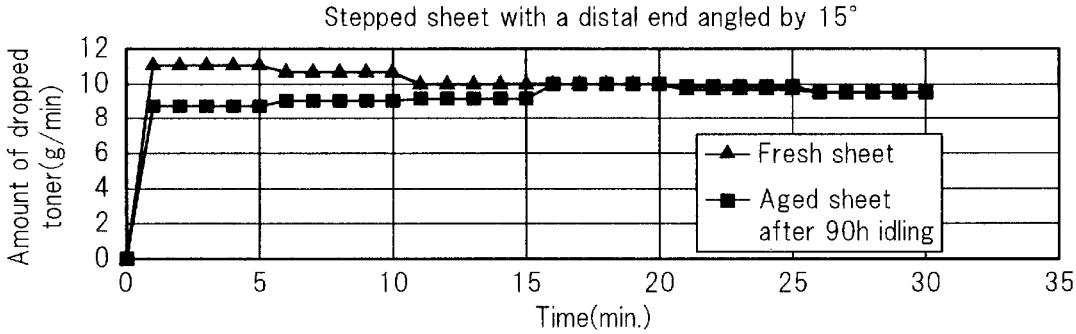
Figure 19C:
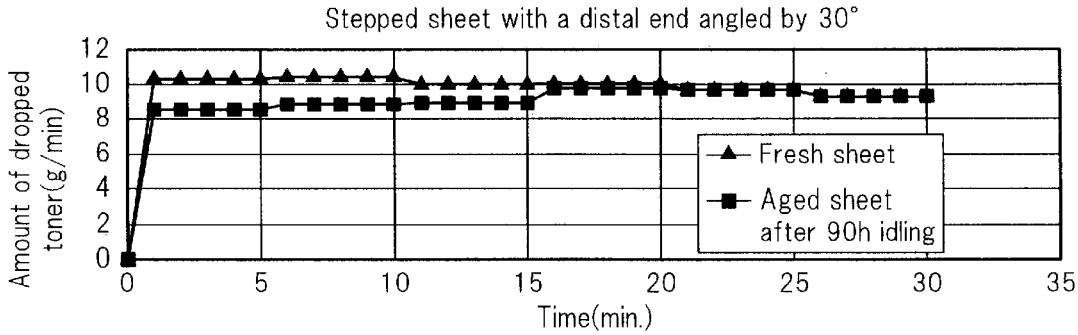
Figure 19D:
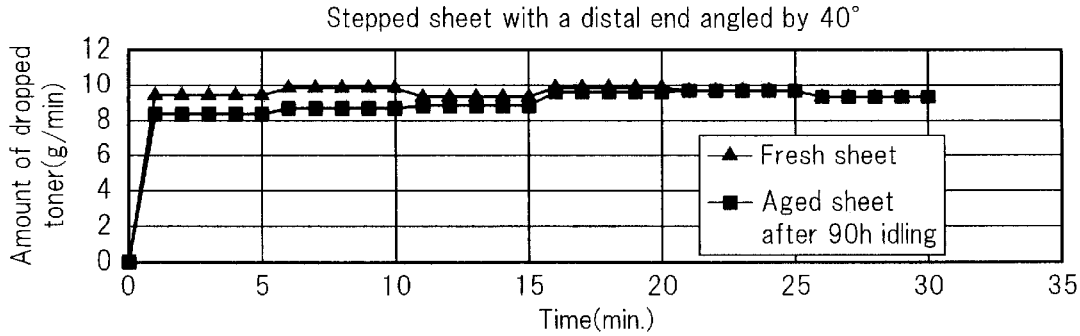
Figure 20A:
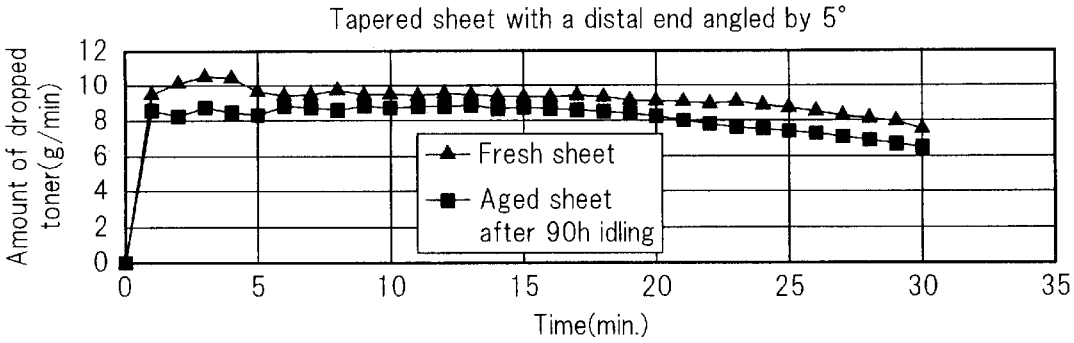
FIGS. 20A to 20D are characteristic charts of toner replenishment of the conveying sheet of the third embodiment of the present invention with its distal end angled at β, where the angle β is varied.
Figure 20B:
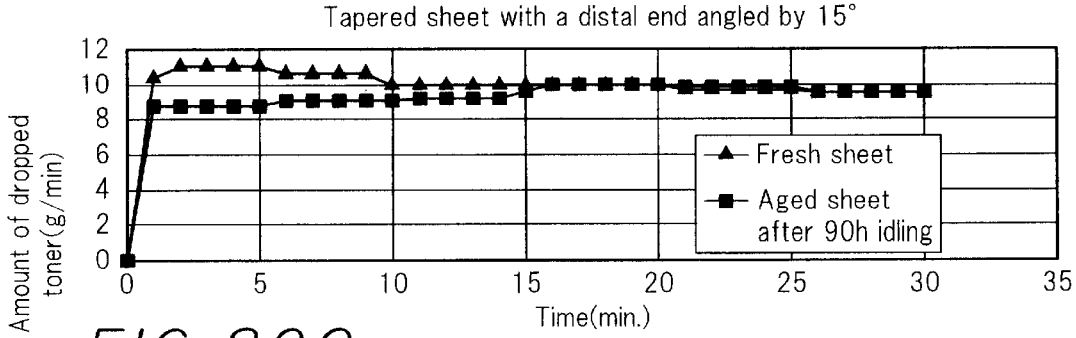
Figure 20C:
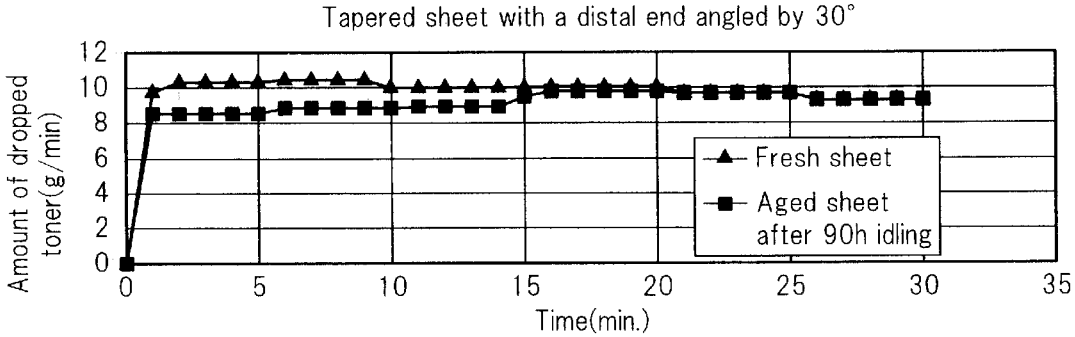
Figure 20D:
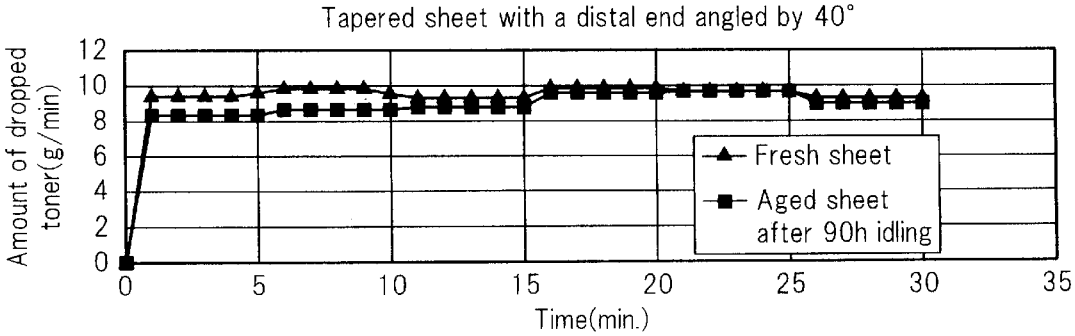

In practice, conveying sheet 58 was assembled with the reinforcing element 45 shown in FIG. 18D and the toner conveyance was evaluated. The result is shown in FIG. 7. From this result, when reinforcing element 45 shown in FIG. 18D was provided, stable toner conveyance was maintained in the long term use of conveying sheet 58 and the plastic deformation of conveying sheet 58 could be inhibited. Thus, it became possible to lengthen the life of conveying sheet 58.

The toner conveying performance when reinforcing element 45 having the structure shown in FIG. 18D was used with conveying sheet 58 was evaluated by varying the projected amount 'h' of reinforcing element 45, in relation to the depth H, or the distance to the bottom of toner reserve container 50. Almost the same results as shown in FIG. 9A to 9C were obtained. Therefore, the projected amount h as to reinforcing element 45 of the third embodiment should set so as to satisfy the relation of $(H/4) \leqq h \leqq (2H/3)$.

For the reinforcing elements 45 in the second and third embodiments described heretofore, the toner conveying performance was tested by varying the projected amount 'h' relative to the thickness 't' of conveying sheet 58. The result obtained was almost the same as shown in FIG. 10, where the conveying performance was plotted by varying the distance h for representing the position of bent portion 58*a* of conveying sheet 58 relative to the thickness t of conveying sheet 58 in the first embodiment.

Specifically, the projected mount 'h' of the reinforcing element In relation to the thickness It of conveying sheet 58 should be set so as to fall within the range of $20t \leqq h \leqq 100t$. In this case, a conveying sheet 58 having a thickness 't' of 0.188 mm was employed. The toner conveying performance was evaluated by varying the projected amount 'h' of reinforcing element 45. In particular, when conveying sheet 58 made up of a thin sheet is used, the projected amount 'h' is made longer so as to maintain the rigidity of conveying sheet 58 and hence secure the necessary toner conveyance.

The Fourth Embodiment of the Present Invention

In the above description of the second and third embodiments heretofore, conveying sheet 58 is formed in a stepped configuration with fixed portion 58*b* or the fixed portion is made to serve as the reinforcing element for conveying sheet 58. With these configurations, it is possible to prevent conveying sheet 58 from becoming unable to revert itself back to its original shape due to whitening as a result of its plastic deformation at the attachment edge of agitator 57, and thus prevent lowering of the toner conveying performance.

In this way, use of conveying sheet 58 having a stepped configuration or use of conveying sheet 58 with reinforcing element 45, in other words, use of any conveying sheet 58 resultantly having a thick attached portion with agitator 57 and a thin free end as conveying portion 58*c*, makes it possible to maintain proper toner conveyance and provide durability against long term use. Not limited to these configurations, a conveying sheet 58 having a thick attached portion with agitator 57 and becoming gradually thinner or tapered as it approaches the free end can also provide continuously stable toner conveyance and present durability against long term use.

Figure 7C:
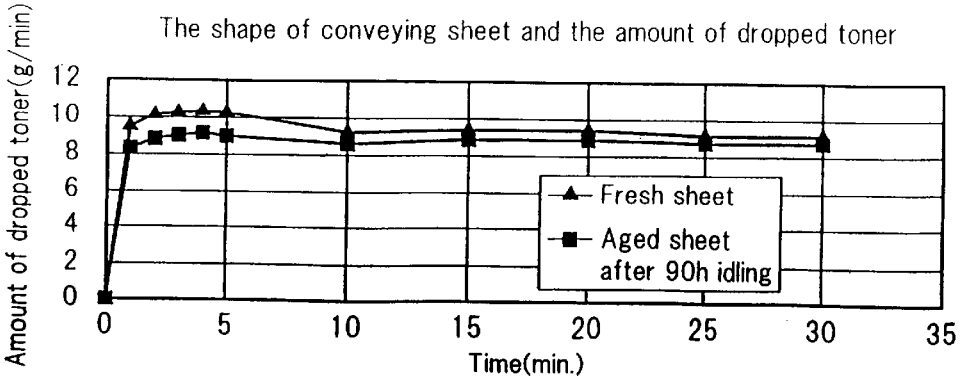

As an example, FIG. 7C shows the result of evaluation as to a conveying sheet 58 having a tapered structure such that its attached portion with agitator 57 was 0.188 mm thick and the distal end was 0.125 mm thick. This result can be compared as to toner conveyance to that shown in FIG. 7A of the conveying sheet 68 having a structure shown in FIG. 1. With reference to FIGS. 7A and 7C, from comparison of the toner conveying performance between this embodiment and that corresponding to FIG. 7A, by remaking the performances of fresh conveying sheets 58 and 68 and the performances of aged, conveying sheets 58 and 68 which have been aged by 90 hours of continuous idling and aging, the following fact can be found.

In the conveying sheet 58 having the structure of this embodiment, the aged one presents almost the same level of toner conveyance as the fresh one, which means that the conveying sheet can maintain stable toner conveyance in the long term use. In contrast, as to the conventional conveying sheet 68 having a constant thickness of 0.188 mm instead of having a tapered configuration, as seen from FIG. 7A, there is a large difference in conveying performance between the conveying sheet after 90 hours of idling and aging and the fresh conveying sheet. In conclusion, also in the conveying sheet 58 according to the fourth embodiment of the present invention, the toner conveyance can be kept stable in the long term, as understood from FIG. 7C.

The tapered conveying sheet 58 of the fourth embodiment of the present invention can be produced directly using the fabrication method described as to the second embodiment. The method can be used especially when the conveying sheet is integrally molded with agitator 57 and when tapered conveying sheet 58 should be formed. It is also possible to integrally mold reinforcing element 45 and agitator 57, including conveying sheet 58 of the third embodiment.

In each of the embodiments of the present invention, in order to secure toner conveyance, especially a sufficient amount of toner conveyance, the distal part of conveying sheet 58 is bent with an angle β as shown in FIG. 3 with respect to the rotational direction to form a retainer 58*d*. Improvability of toner conveyance by such a configuration is disclosed as in Japanese Patent Application Laid-Open Hei 10 No.123815. FIG. 19 and 20 show evaluation results of conveying sheets 58 with retainer 58*d* applied to the configurations of the second and fourth embodiments of the present invention, respectively.

FIGS. 19 and 20 show the toner conveying performance of conveying sheets 58 of the second and fourth embodiments, by varying the bent angle β is varied. These charts also show the results based on the comparison between the fresh conveying sheet and the sheet after 90 hours of idling and aging.

When the bent angle β is about 5°, there is a little difference between the fresh conveying sheet and that aged after 90 hours, but both the amounts of conveyance gradually lower. When the bent angle β is set at about 15°, the amount of toner conveyance can be sufficiently secured for both the sheets, which means that the conveying performance can be kept stably for a long period of time. The bent angle β is optimally determined to fall within the range of 15° to 35°. This result is equivalent to that disclosed in the aforementioned publication.

Though the bent angle β of this retainer 58*d* has been mentioned as examples in the second and fourth embodiments of the present invention, naturally this can be applied similarly to the conveying sheet 58 of the first embodiment shown in FIG. 3 of the present invention and the one when reinforcing element 45 is provided in the third embodiment and can produce a preferred conveying performance.

Figure 21A:
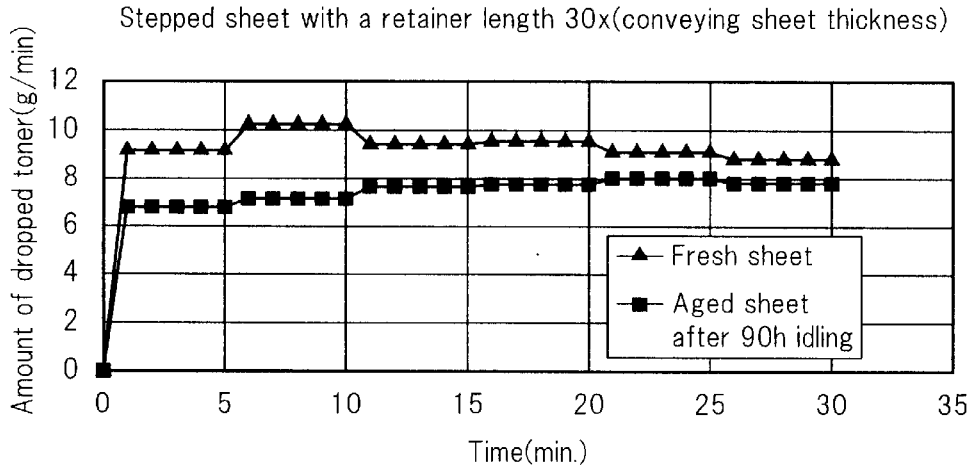
FIGS. 21A to 21C are characteristic charts of toner replenishment of the conveying sheet of the second embodiment of the present invention where the length of a retainer formed at the distal end of the conveying sheet is varied.
Figure 21B:
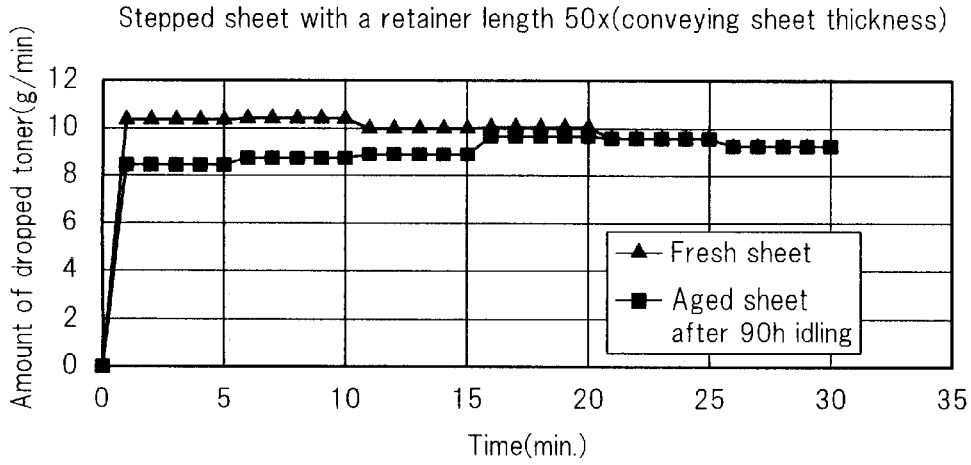
Figure 21C:
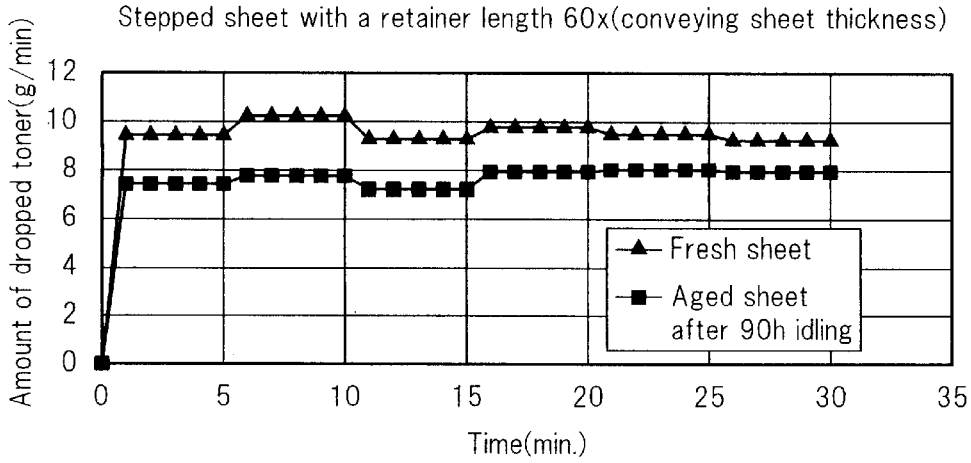

FIG. 21 shows the results of the similar comparison as to the length of angled retainer 58*d*. The results are shown with the length of retainer 58*d* set at 30 times, 50 times and 60 times of the thickness at the distal part of conveying sheet 58. When a retainer 58*d* capable of providing sufficient conveyance was arranged at the front end of conveying sheet 58 and the length of the retainer was set at 50 times of the thickness of the sheet, the most preferable result was obtained. When the length of the retainer was set at 30 times or 60 times of the thickness, it was confirmed that a high enough amount of conveyance can be secured for a long period of time through the amount of toner conveyance gradually lowered Though not shown in FIG. 21, the length of retainer 58*d* should be at least 24 times of the sheet thickness. As to the upper boundary, sufficient conveyance can be assured as seen in figure when it is set at 60 times of the sheet thickness. However, since some difference in the amount of conveyance is recognized, the maximum length is set at about 56 times of the sheet thickness.

For explanation of FIG. 21, the conveying sheet 58 having the structure described in the second embodiment was taken as an example. Naturally this can be applied similarly and directly to the conveying sheet 58 of the first embodiment and the conveying sheet 58 of the third embodiment with reinforcing element 45 provided. And these cases could produce equivalent results, assuring the conveyance performance as shown in FIG. 21. Further, the specifications can also be applied to the conveying sheet 58 having the structure of the fourth embodiment. Though the thickness of conveying sheet 58 in the fourth embodiment varies dependent on the position since the conveying sheet 58 is formed in a tapered shape, the thickness at the distal end should be used for the measurement.

As has been described heretofore, according to the present invention, conveying sheet 58 attached to agitator 57 as a rotator is formed with bent portion 58*a* deflected at a point halfway in the first embodiment; the conveying sheet is formed by a stepped configuration where conveying portion 58*c* in charge of toner conveyance is made thicker in the second embodiment; the conveying sheet is formed with a separate reinforcing element 45 in the third embodiment; and the conveying sheet is formed so as to become gradually thinner or tapered toward the distal end in the fourth embodiment. With any of the above configurations, it is possible to inhibit conveying sheet 58 from being plastically deformed at the attachment edge 'd' of agitator 57 and hence prevent the sheet from being whitened, which will cause the sheet to be unable to recover its original shape due to plastic deformation at 'd' . Thus, it is possible to secure toner conveyance in the long term and realize stable toner conveyance.

Since the position of bent portion 58*a* of conveying sheet 58, or the position of the stepped portion is set by the relation to the depth H of toner reserve container 50 and the like, it is possible to secure the proper conveyance, and keep stable conveyance for a long period of time.

According to the developing unit equipped with a toner replenishing device described heretofore, it is possible to continuously perform toner conveyance to the replenishing portion for supplying the toner to the developing hopper constituting the developing unit, in a stable efficient manner.

The life of the conveying sheet attached to the rotator for toner replenishment can be made longer while stable toner supply can be secured continuously.

Particularly, the conveying sheet is inhibited from being plastically deformed at the attachment edge to the rotator, so that the sheet can keep excellent toner conveyance for a long period of time, whereby the frequency of replacement of the conveying sheets or the frequency of replacement of the conveying sheets including the rotator can be reduced markedly.

Further, it is possible to provide high enough rigidity to the conveying sheet, thus making it possible to secure the adequate toner conveyance and hence maintain its conveying performance for a long period of time.

From the above result, since the developing of the invention is able to secure continuously stable toner conveyance, it is possible-to keep stable image quality.

What is claimed is:

1. A developing unit equipped with a toner replenishing device having a toner reserve container for supplying the toner to a developing hopper as required and a replenishing portion for supplying the toner stored in the toner reserve container to the developing hopper, comprising:

a rotator incorporated in the toner reserve container so as to be rotatable for agitating the stored toner; and a conveying sheet of a flexible material attached to the rotator for scooping up the toner stored in the toner reserve container and conveying the toner into the replenishing portion, wherein the conveying sheet is bent in the rotational direction of the rotator at a halfway point thereof with a predetermined angle α, forming a bent portion.

2. The developing unit equipped with a toner replenishing device according to claim 1, wherein the bent portion is formed in a curving shape.

3. The developing unit equipped with a toner replenishing device according to claim 1, wherein the angle α at the bent portion is set within the range from 90° to 170°.

4. The developing unit equipped with a toner replenishing device according to claim 1, wherein h is set at a value within the range of $(H/4) \leqq h \leqq (2H/3)$, where H is the distance from the attached position of the conveying sheet with the rotator to the bottom of the toner reserve container and h is the distance from the position of the bent portion of the conveying sheet to the attachment edge of the rotator.

5. The developing unit equipped with a toner replenishing device according to claim 1, wherein h is set at a value within the range of $20t \leqq h \leqq 100t$, where t is the thickness of the conveying sheet and h is the distance from the position of the bent portion of the conveying sheet to the attachment edge of the rotator.

6. A developing unit equipped with a toner replenishing device having a toner reserve container for supplying the toner to a developing hopper as required and a replenishing portion for supplying the toner stored in the toner reserve container to the developing hopper, comprising:

a rotator incorporated in the toner reserve container so as to be rotatable for agitating the stored toner; and a conveying sheet of a flexible material attached to the rotator for scooping up the toner stored in the toner reserve container and conveying the toner into the replenishing portion, wherein the conveying sheet is composed of a fixed portion for attachment to the rotator and a conveying portion for scooping up and conveying the toner on the free end side, having a thickness smaller than that of the fixed portion, and wherein the fixed portion and conveying portion having different thicknesses.

7. A developing unit equipped with a toner replenishing device having a toner reserve container for supplying the toner to a developing hopper as required and a replenishing portion for supplying the toner stored in the toner reserve container to the developing hopper, comprising:

a rotator incorporated in the toner reserve container so as to be rotatable for agitating the stored toner; and a conveying sheet of a flexible material attached to the rotator for scooping up the toner stored in the toner reserve container and conveying the toner into the replenishing portion, wherein the conveying sheet is composed of a fixed portion for attachment to the rotator and a conveying portion for scooping up and conveying the toner on the free end side, having a thickness smaller than that of the fixed portion, wherein h is set at a value within the range of $(H/4) \leqq h \leqq (2H/3)$, where h is the distance from the position at which the thickness of the conveying sheet changes between the fixed portion and the conveying portion to the attachment edge of the rotator and H is the distance from the attached position of the fixed portion with the rotator to the bottom of toner reserve container.

8. A developing unit equipped with a toner replenishing device having a toner reserve container for supplying the toner to a developing hopper as required and a replenishing portion for supplying the toner stored in the toner reserve container to the developing hopper, comprising:

a rotator incorporated in the toner reserve container so as to be rotatable for agitating the stored toner;

a conveying sheet of a flexible material attached to the rotator for scooping up the toner stored in the toner reserve container and conveying the toner into the replenishing portion; and a reinforcing element arranged projectively in the rotational direction of the rotator and attached to the rotator, wherein the conveying sheet is attached to the rotator via the reinforcing element, and wherein the reinforcing element is greater in thickness or longer in projected amount in the areas corresponding to both extremes of the conveying sheet than in the area corresponding to the central area of the conveying sheet.

9. The developing unit equipped with a toner replenishing device according to claim 8, wherein the conveying sheet is bonded to the reinforcing element at an area corresponding to the area where the reinforcing element is attached to the rotator and the other part of the conveying sheet is unbonded with respect to the reinforcing element.

10. The developing unit equipped with a toner replenishing device according to claim 8, wherein the reinforcing element is formed of a material thicker than the conveying sheet.

11. The developing unit equipped with a toner replenishing device according to claim 8, wherein the reinforcing element has a bent or curved portion at the distal end thereof.

12. A developing unit equipped with a toner replenishing device having a toner reserve container for supplying the toner to a developing hopper as required and a replenishing portion for supplying the toner stored in the toner reserve container to the developing hopper, comprising:

a rotator incorporated in the toner reserve container so as to be rotatable for agitating the stored toner;

a conveying sheet of a flexible material attached to the rotator for scooping up the toner stored in the toner reserve container and conveying the toner into the replenishing portion; and a reinforcing element arranged projectively in the rotational direction of the rotator and attached to the rotator, wherein the conveying sheet is attached to the rotator via the reinforcing element, and a reinforcing element arranged projectively in the rotational direction of the rotator and attached to the rotator, wherein the conveying sheet is attached to the rotator via the reinforcing element, wherein the reinforcing element has a bent or curved portion at the distal end thereof, and wherein the width of the bent or curved portion is made greater in the areas corresponding to both extremes of the conveying sheet than in the area corresponding to the central area of the conveying sheet.

13. A developing unit equipped with a toner replenishing device having a toner reserve container for supplying the toner to a developing hopper as required and a replenishing portion for supplying the toner stored in the toner reserve container to the developing hopper, comprising:

a rotator incorporated in the toner reserve container so as to be rotatable for agitating the stored toner;

a conveying sheet of a flexible material attached to the rotator for scooping up the toner stored in the toner reserve container and conveying the toner into the replenishing portion; and a reinforcing element arranged projectively in the rotational direction of the rotator and attached to the rotator, wherein the conveying sheet is attached to the rotator via the reinforcing element, and a reinforcing element arranged projectively in the rotational direction of the rotator and attached to the rotator, wherein the conveying sheet is attached to the rotator via the reinforcing element, and wherein the reinforcing element has a corrugated structure having a section of a continuous semicircular, trapezoidal, sinusoidal or other concavo-convex series.

14. A developing unit equipped with a toner replenishing device having a toner reserve container for supplying the toner to a developing hopper as required and a replenishing portion for supplying the toner stored in the toner reserve container to the developing hopper, comprising:

a rotator incorporated in the toner reserve container so as to be rotatable for agitating the stored toner;

a conveying sheet of a flexible material attached to the rotator for scooping up the toner stored in the toner reserve container and conveying the toner into the replenishing portion; and a reinforcing element arranged projectively in the rotational direction of the rotator and attached to the rotator, wherein the conveying sheet is attached to the rotator via the reinforcing element, and a reinforcing element arranged projectively in the rotational direction of the rotator and attached to the rotator, wherein the conveying sheet is attached to the rotator via the reinforcing element, and wherein h is set at a value within the range of $(H/4) \leqq h \leqq (2H/3)$, where h is the projected amount of the reinforcing element and H is the distance from the attached position of the fixed portion with the rotator to the bottom of toner reserve container.

15. A developing unit equipped with a toner replenishing device having a toner reserve container for supplying the toner to a developing hopper as required and a replenishing portion for supplying the toner stored in the toner reserve container to the developing hopper, comprising:

a rotator incorporated in the toner reserve container so as to be rotatable for agitating the stored toner; and a conveying sheet of a flexible material attached to the rotator for scooping up the toner stored in the toner reserve container and conveying the toner into the replenishing portion, wherein the conveying sheet has a tapered configuration such that the thickness becomes gradually thinner from the position attached to the rotator toward the free end side which performs toner conveyance.

16. The developing unit equipped with a toner replenishing device according to any one of claims 1, 6, 8 and 15, wherein the conveying sheet to be attached to the rotator is integrally molded.

* * * * *